US011426012B2

(12) United States Patent
Zadrozny et al.

(10) Patent No.: US 11,426,012 B2
(45) Date of Patent: Aug. 30, 2022

(54) PLAY YARD MATTRESS ATTACHMENT

(71) Applicant: MONAHAN PRODUCTS, LLC, Rockland, MA (US)

(72) Inventors: Alex Richard Zadrozny, Pembroke, MA (US); Luis Alejandro Canas, Stoughton, MA (US); Julianne Marie Depardieu, Braintree, MA (US); Eric Howard Perlman, Weymouth, MA (US); Richard M. Bastien, Cumberland, RI (US); Christina Dewey, Stoughton, MA (US); Trung Q. Phung, Milton, MA (US)

(73) Assignee: MONAHAN PRODUCTS, LLC, Rockland, MA (US)

( * ) Notice: Subject to any disclaimer, the term of this patent is extended or adjusted under 35 U.S.C. 154(b) by 76 days.

(21) Appl. No.: 16/904,229

(22) Filed: Jun. 17, 2020

(65) Prior Publication Data

US 2021/0393050 A1 Dec. 23, 2021

(51) Int. Cl.
*A47D 13/06* (2006.01)
*A47D 7/00* (2006.01)

(52) U.S. Cl.
CPC ..... *A47D 13/066* (2013.01); *A47D 7/002* (2013.01); *A47D 13/063* (2013.01)

(58) Field of Classification Search
CPC .... A47D 13/06; A47D 13/061; A47D 13/063; A47D 13/065; A47D 13/066; A47D 13/068; A47D 7/00; A47D 7/002; A47D 7/005; A47D 7/03
USPC ..... 292/11, 44
See application file for complete search history.

(56) References Cited

U.S. PATENT DOCUMENTS

| | | | | |
|---|---|---|---|---|
| 2,763,505 | A * | 9/1956 | Krause | E05B 83/24 292/226 |
| 3,026,131 | A * | 3/1962 | Krause | E05B 83/247 292/52 |
| 3,463,529 | A * | 8/1969 | Lo | E05B 83/24 292/106 |
| 3,706,105 | A * | 12/1972 | Nicholas | A47D 13/06 5/93.1 |
| 6,408,463 | B1 * | 6/2002 | Palacio | A47D 15/003 5/655 |
| 7,506,902 | B2 * | 3/2009 | Sheng | G03G 21/1666 292/133 |
| 10,918,223 | B2 * | 2/2021 | Goodwin | A47D 15/001 |
| 11,033,118 | B2 * | 6/2021 | Fok | A47D 13/107 |
| 2004/0187207 | A1 * | 9/2004 | Hsia | A47D 7/03 5/99.1 |
| 2007/0214576 | A1 * | 9/2007 | Espenshade | A47D 15/003 5/99.1 |

(Continued)

*Primary Examiner* — Peter M. Cuomo
*Assistant Examiner* — George Sun
(74) *Attorney, Agent, or Firm* — Lando & Anastasi, LLP

(57) ABSTRACT

A child play yard includes a frame, a floor coupled to a lower portion of the frame, and a mattress configured to be removably coupled to the floor. The mattress includes a lower side to which is coupled a clip assembly including a base and a leg pivotally coupled to the base. The leg includes a detent extending therefrom. The floor includes a retention assembly having a first aperture through which the leg of the clip assembly passes and a second aperture through which the detent passes when the mattress is coupled to the floor.

16 Claims, 33 Drawing Sheets

(56) References Cited

U.S. PATENT DOCUMENTS

| | | | | |
|---|---|---|---|---|
| 2010/0017959 | A1* | 1/2010 | Yoshe | A47D 13/063 5/99.1 |
| 2013/0180047 | A1* | 7/2013 | Veronneau | A47D 7/00 5/93.2 |
| 2013/0312178 | A1* | 11/2013 | Jackson | A47D 13/06 5/93.1 |
| 2014/0068856 | A1* | 3/2014 | Thomson | A47D 7/03 5/93.1 |
| 2016/0258461 | A1* | 9/2016 | Muller | F16B 5/0607 |
| 2018/0310734 | A1* | 11/2018 | O'Malley | A47D 13/06 |
| 2020/0352352 | A1* | 11/2020 | Fusco | A47D 13/06 |
| 2021/0137280 | A1* | 5/2021 | Villano | A47D 15/008 |
| 2021/0289946 | A1* | 9/2021 | Kim | A47C 4/286 |

* cited by examiner

PLAY YARD MATTRESS ATTACHMENT

BACKGROUND

Aspects and examples of the present disclosure are directed generally to a child enclosure, for example, a play pen, play yard, or crib, generally referred to herein as a play yard, and to mechanisms and methods for removably securing a mattress to the floor of the play yard.

SUMMARY

In accordance with an aspect, there is provided a child play yard. The play yard comprises a frame, a floor coupled to a lower portion of the frame, and a mattress configured to be removably coupled to the floor. The mattress includes a lower side to which is coupled a clip assembly including a base and a leg pivotally coupled to the base. The leg includes a detent extending therefrom. The floor includes a retention assembly having a first aperture through which the leg of the clip assembly passes and a second aperture through which the detent passes when the mattress is coupled to the floor.

In some embodiments, the base of the clip assembly is secured to the lower side of the mattress by one or stitching, sewing, or an adhesive.

In some embodiments, the clip assembly further includes raised side walls extending upward from the base and apertures defined in the raised side walls, the apertures configured to retain a pin that pivotally couples the leg to the base. The clip assembly may further include a loop portion extending rearward and upward from the raised side walls. The clip assembly may further include a raised plateau extending upward from the base. The clip assembly may further include a cavity having a rounded bottom defined between the raised side walls, a front wall of the loop portion, and a rear of the raised plateau. The raised plateau and leg may define a cavity in which a portion of the retention assembly is retained when the mattress is coupled to the floor. The portion of the retention assembly may be defined between the first aperture and the second aperture. The leg may include a rounded proximal end pivotally coupled to the base within the cavity.

In some embodiments, the clip assembly further includes a detent retention aperture defined in the base in which the detent is disposed when the mattress is coupled to the floor.

In some embodiments, the retention assembly is secured to the floor by one of stitching, sewing, or an adhesive.

In accordance with another aspect, there is provided a method of removably securing a mattress to a floor of a play yard. The method comprises placing the mattress on the floor of the play yard, passing a leg of a clip assembly through a first aperture in a retention assembly coupled to the floor of the play yard from an upper side of the floor to a lower side of the floor, passing a detent coupled to the leg of the clip assembly through a second aperture in the retention assembly from the lower side of the floor to the upper side of the floor by rotating the leg of the clip assembly relative to the base assembly, and removably securing the detent in a detent retention aperture defined in the base.

In some embodiments, securing the mattress to the floor of the play yard includes securing a first end of the mattress to the floor of the play yard with a plurality of clip assemblies and associated retention assemblies. Securing the mattress to the floor of the play yard may further include securing a second end of the mattress opposite to the first end of the mattress to the floor of the play yard with a second plurality of clip assemblies and associated retention assemblies.

In some embodiments, securing the mattress to the floor of the play yard includes trapping a portion of the retention assembly defined between the first aperture and the second aperture between a lower side of the clip and a raised plateau extending upward from the base.

In some embodiments, removably securing the detent in the detent retention aperture includes applying a force to a handle portion of the leg.

In some embodiments, the method of further comprises removing the mattress from the play yard, rolling the mattress into a closed configuration, and securing the mattress in the closed configuration by coupling a loop portion of the clip assembly to a loop portion of a second clip assembly coupled to the mattress with a fastener.

In accordance with another aspect, there is provided a child play yard. The play yard comprises a frame, a floor coupled to a lower portion of the frame, and a mattress configured to be removably coupled to the floor, the mattress including a lower side to which is coupled a clip including a base and legs extending from the base, the clip configured to removably retain a frame member of the play yard.

In accordance with another aspect, there is provided a child play yard. The play yard comprises a frame, a floor coupled to a lower portion of the frame, a mattress configured to be removably coupled to the floor, the mattress including a lower side to which is coupled one or more extrusions, and one or more extrusion receiving clips mounted to frame members of a frame of the play yard and configured to releasably retain a corresponding extrusion.

In accordance with another aspect, there is provided a child play yard. The play yard comprises a frame, a floor coupled to a lower portion of the frame, a mattress configured to be removably coupled to the floor, the mattress including a lower side to which is coupled a turn lock assembly including a locking detent, and a turn lock retention assembly coupled to the floor of the play yard including an aperture through which the locking detent may pass when in an unlocked rotational position, but through which the locking detent may not pass when in a locked rotational position.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
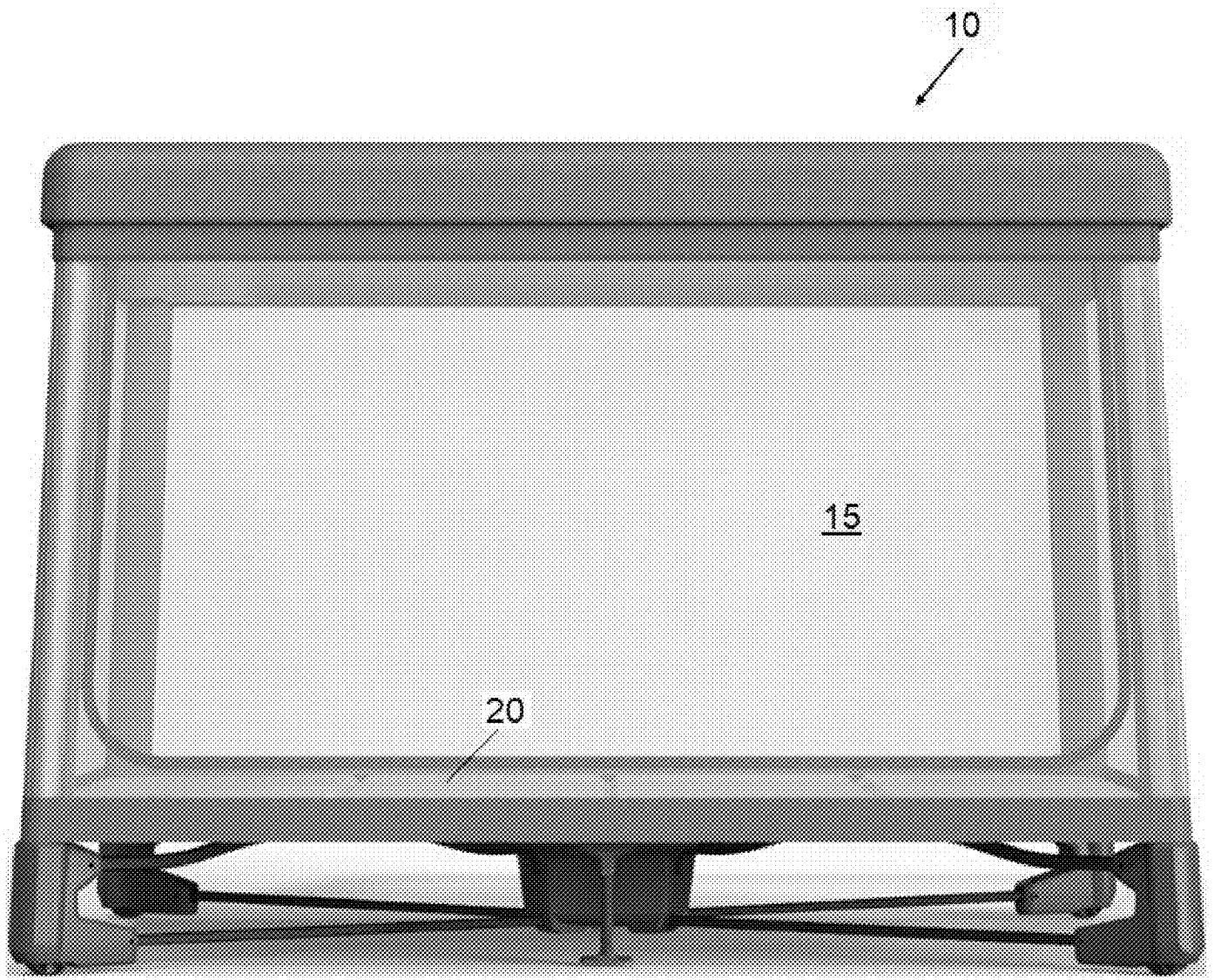
FIG. 1 is an elevational view from the front of a play yard.

The disclosure is not limited in its application to the details of construction and the arrangement of components set forth in the following description or illustrated in the drawings. The disclosure is capable of other examples and of being practiced or of being carried out in various ways. Also, the phraseology and terminology used herein is for the purpose of description and should not be regarded as limiting. The use of "including," "comprising," "having," "containing," "involving," and variations thereof herein is meant to encompass the items listed thereafter and equivalents thereof as well as additional terms.

Parents or caregivers of young children may place the children in an enclosure, referred to herein as a play yard, that provides for the children to play with toys or rest while preventing the children from wandering and potentially injuring themselves. A play yard may include a frame that supports a lower floor, for example, a mattress or other soft surface, and upright legs and cross rails that support an enclosing material, for example, a fabric or mesh. In various implementations the frame may lock in an open position during use and include a mechanism to unlock the frame to allow it to be folded into a small form factor for transport or storage. One example of a play yard is illustrated generally at 10 in FIG. 1. Fabric forming the walls of the play yard is indicated in FIG. 1 at 15 and a mattress on a floor of the play yard is indicated at 20. In some embodiments, the mattress may include or consist of a thin layer of fabric or cushioning.

Figure 2:
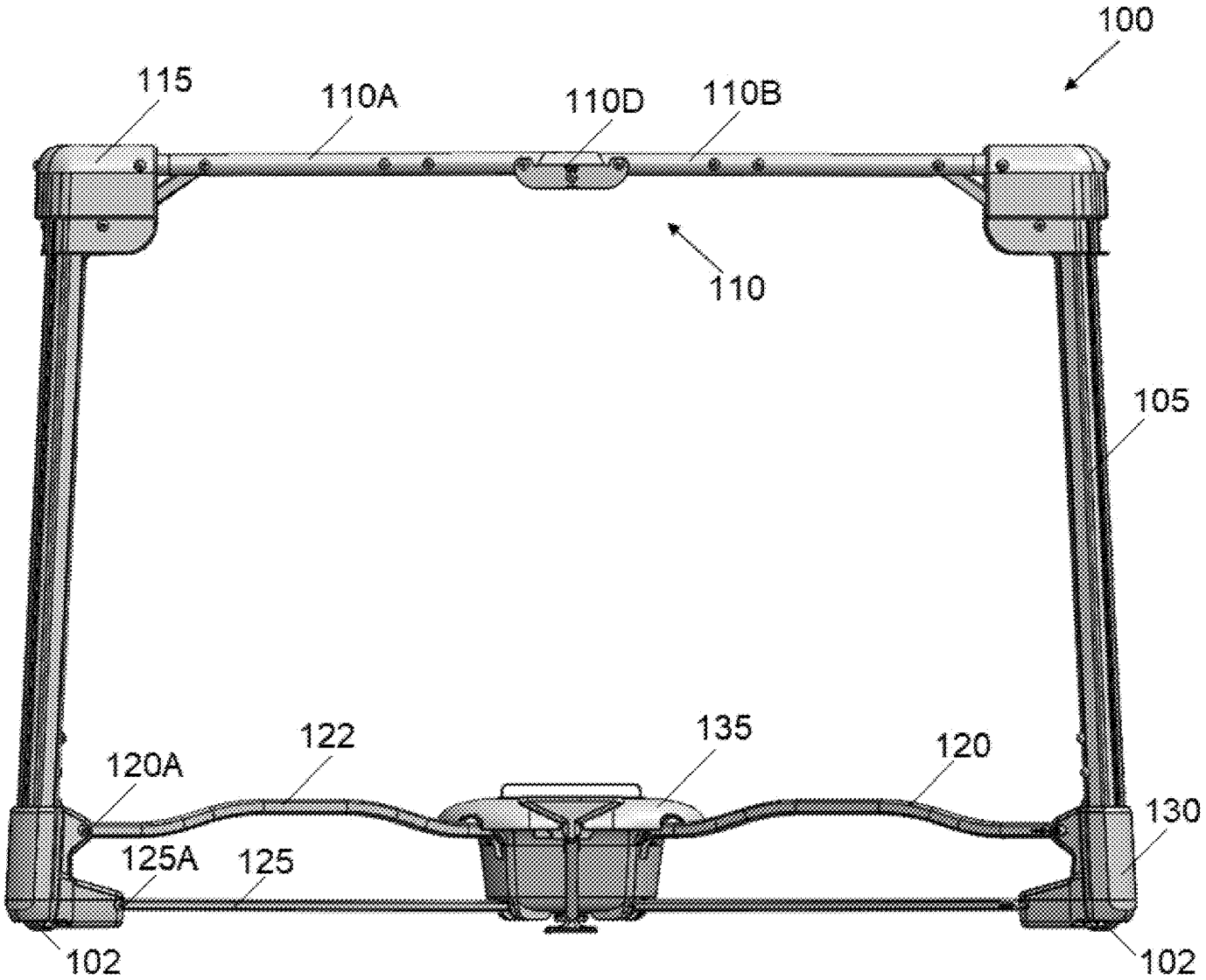
FIG. 2 is an elevational view of a frame for a play yard.

FIG. 2 illustrate the frame 100 of an embodiment of a play yard in an open arrangement in a front elevational view. The frame 100 of the play yard includes four generally vertically extending legs 105 which, as illustrated in FIG. 2, may be oriented at a small angle, for example, 1-10 degrees tilted toward the center of the play yard, relative to vertical when the frame 100 is upright in an open configuration. Wheels 102 may be provided on the lower ends of the legs 105 to help the legs 105 slide inward and outward as the frame 100 transitions between open and folded configurations and back. The legs 105 are coupled to upper cross bars 110 at the top of the frame 100 through upper corner linkage covers 115. The upper cross bars 110 include two portions 110A, 110B. The cross bar portions 110A, 110B have proximal ends that are pivotally joined together with cross bar latches 110D. Distal ends of the cross bar portions 110A, 110B are pivotally coupled to a corner plate within the respective upper corner linkage covers 115.

The frame 100 further includes lower cross bars, referred to as lower fourbar tops 120 and lower fourbar bottoms 125 having distal ends 120A, 125A pivotally coupled to lower corner linkage covers 130. The lower fourbar tops 120 may include flattened middle portions 122 that may be used to support a mattress 20 in the play yard 10. Proximal ends of the lower fourbar tops 120 and lower fourbar bottoms 125 are pivotally coupled to a hub 135 that is disposed generally centrally in a bottom portion of the frame 100. As discussed in co-pending U.S. patent application Ser. No. 16/862,036, the contents of which are incorporated by reference herein in their entirety, the hub 135 includes a mechanism for maintaining the lower fourbar tops 120 and lower fourbar bottoms 125 in a horizontal orientation when the frame is locked, but allows for the lower fourbar tops 120 and lower fourbar bottoms 125 to rotate about pivot points within the hub 135 and the lower corner linkage covers 130 when the frame 100 is unlocked to allow the frame 100 to be folded.

Also pivotally coupled to the hub 135 are a pair of stabilizer legs 140. The stabilizer legs 140 help to keep the play yard from tipping over when the stabilizer legs 140 are in their extended position. The stabilizer legs 140 may also rotate about pivot points within the hub 135 when the frame 100 is unlocked to allow the frame 100 to be folded.

Figure 3:
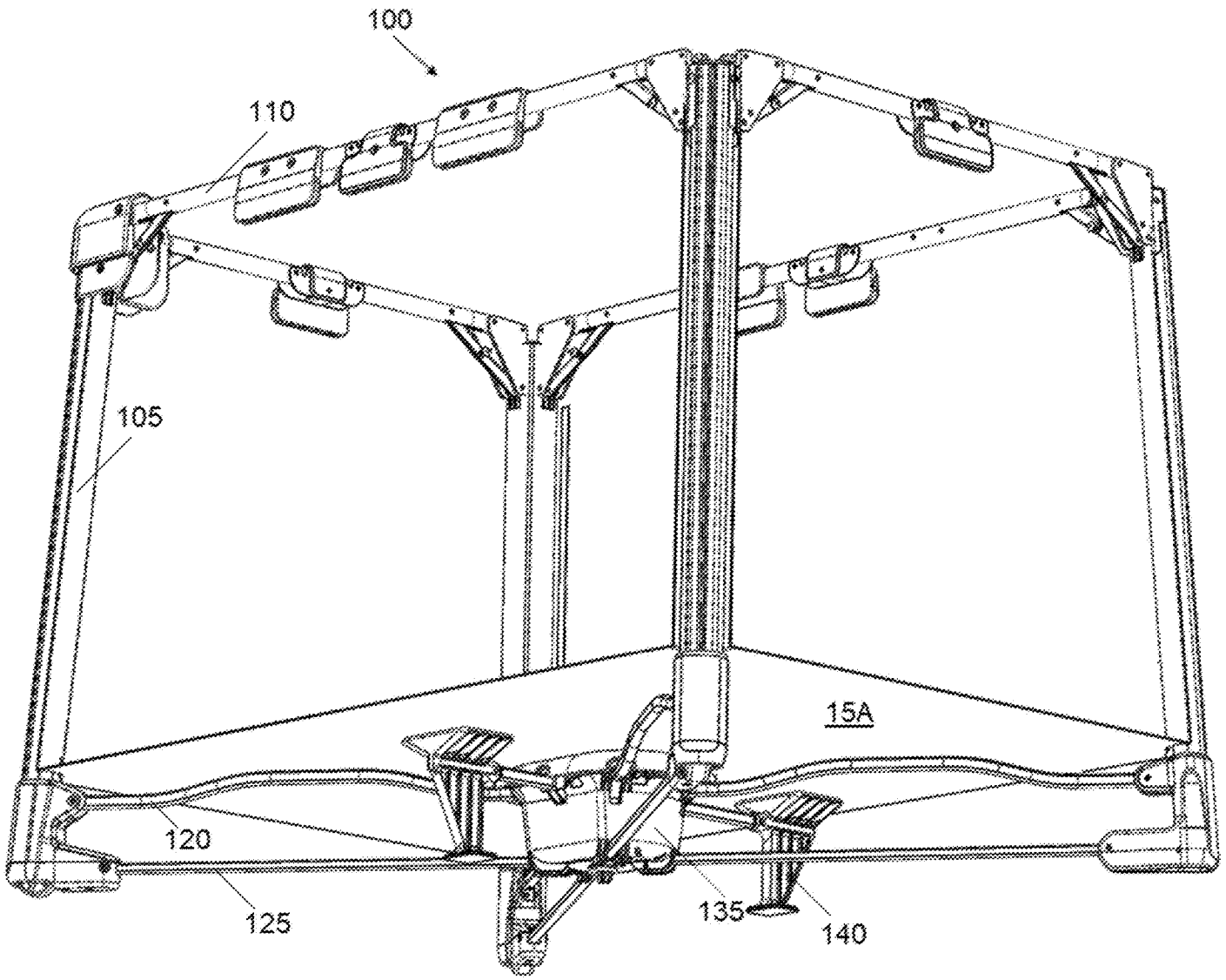
FIG. 3 is a partial isometric view of a frame of a play yard including fabric forming a floor of the play yard.

Fabric 15 may be disposed on the frame 100 to form walls of the play yard as illustrated in FIG. 1. The fabric 15 includes a portion, illustrated in FIG. 3, that covers the bottom structure (cross bars and hub) of the frame of the play yard to form a floor 15A. The floor 15A may, in some embodiments, include or consist of a nylon or fabric covering. The mattress 20 as illustrated in FIG. 1 is disposed on top of the fabric floor 15A.

It has been found desirable to provide a mechanism to secure the mattress 20 of a play yard 10 to the floor 15A of the play yard 10. This helps prevent a child within the play yard 10 from pulling up a portion of the mattress 20 and becoming trapped under the mattress 20 or becoming caught on a strap or other feature that may be present on an underside of the mattress 20. The mattress 20 is also desirably removable from the play yard 10 to provide for the frame 100 to more easily fold closed for storage or transportation.

Figure 4:
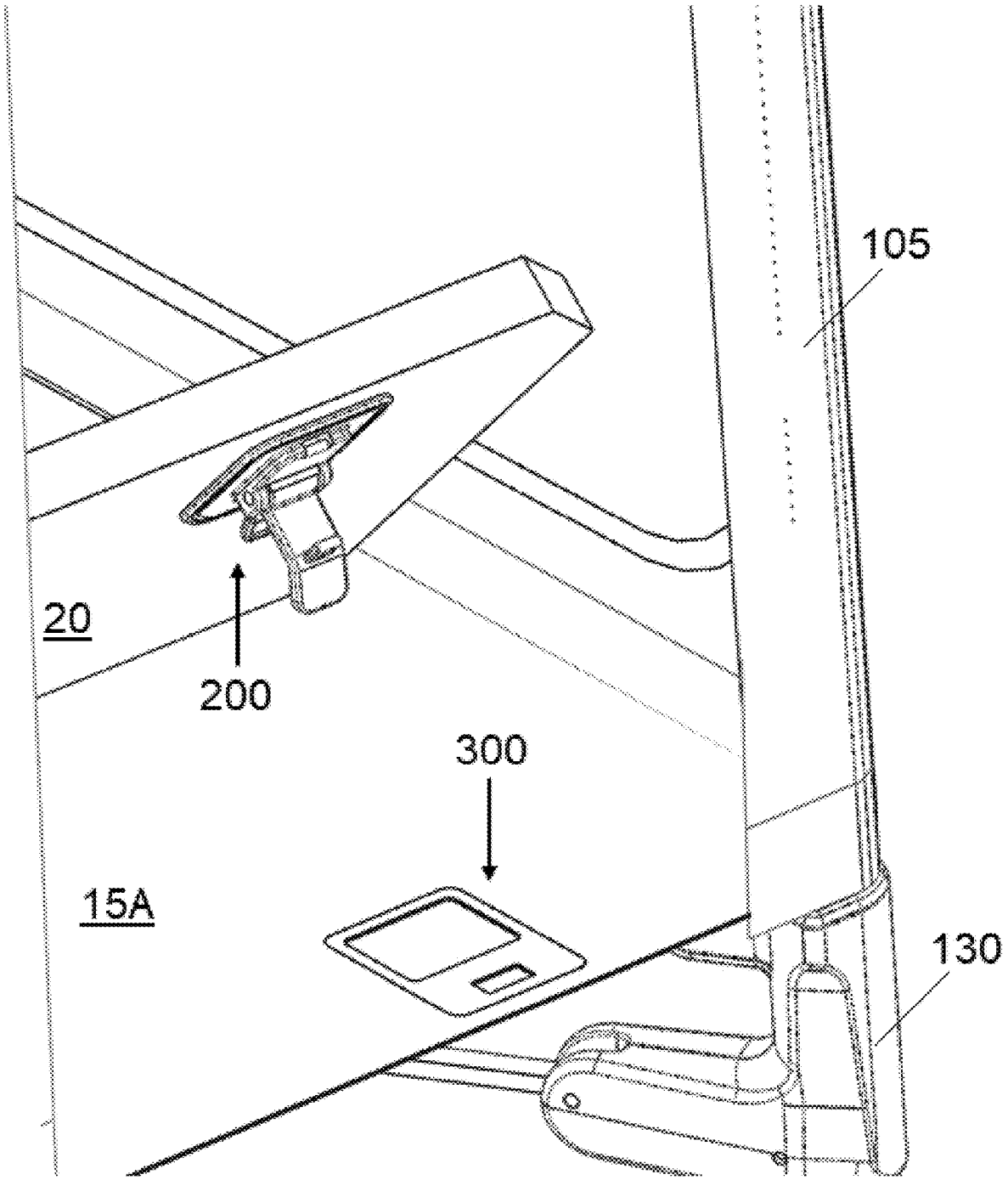
FIG. 4 is a partial isometric view of a play yard illustrating a mechanism for removably attaching a mattress to a floor of the play yard.

One example of a mechanism to removably secure the mattress 20 of a play yard 10 to the floor of the play yard 10 is illustrated in FIG. 4. The mechanism includes a clip assembly, indicated generally at 200, that is attached to or formed integral with the underside of the mattress 20, and a retention assembly, indicated generally at 300, that is attached to or formed integral with the floor 15A. The clip assembly 200 is illustrated in FIG. 4 in an open configuration. In some embodiments, the mechanism to removably secure the mattress of the play yard to the floor of the play yard, for example, the clip assembly 200, may be spring loaded to keep it in a closed orientation absent application of a force to open it.

Figure 5A:
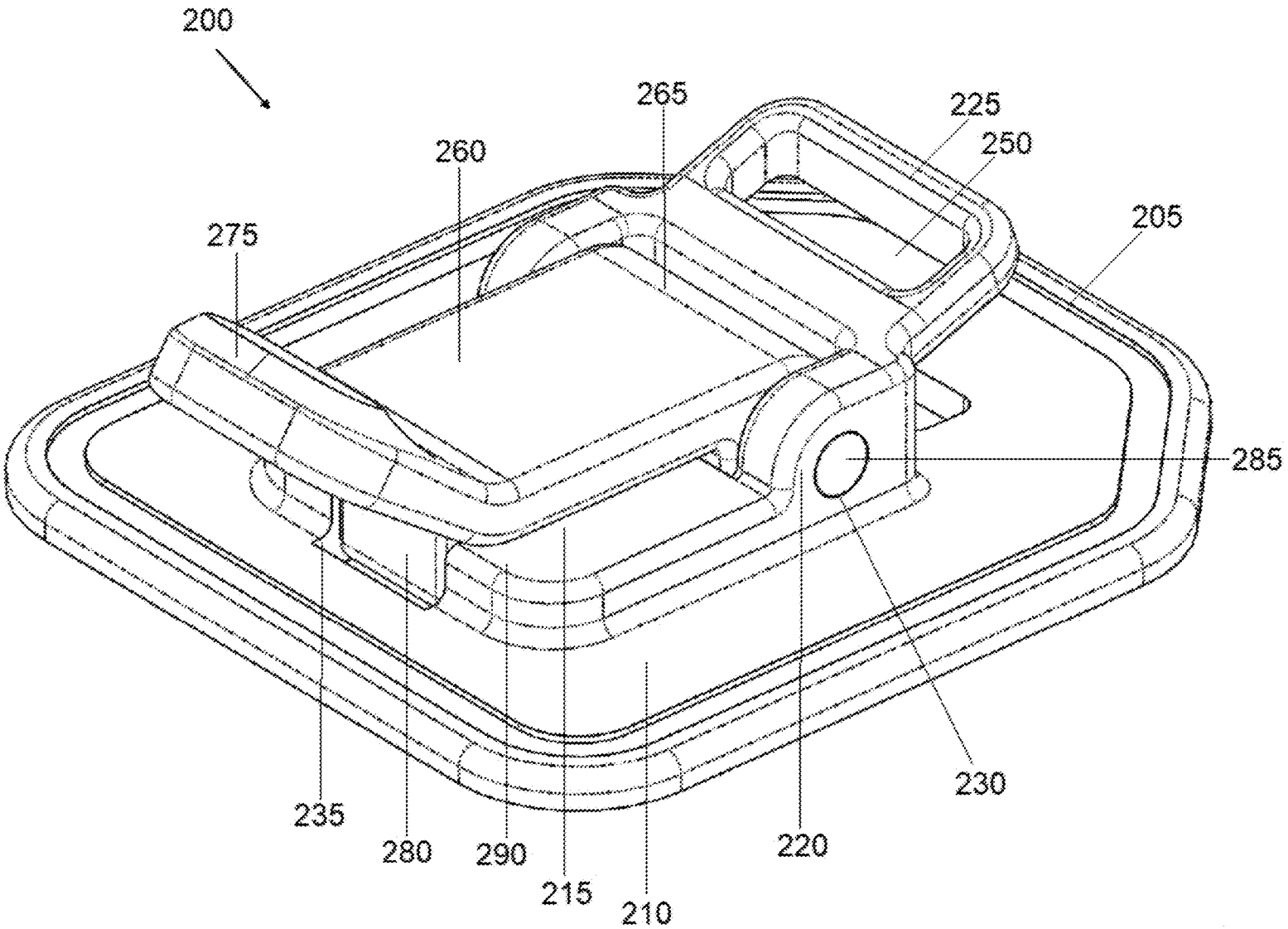
FIG. 5A is an isometric view of a clip assembly of a play yard.
Figure 5B:
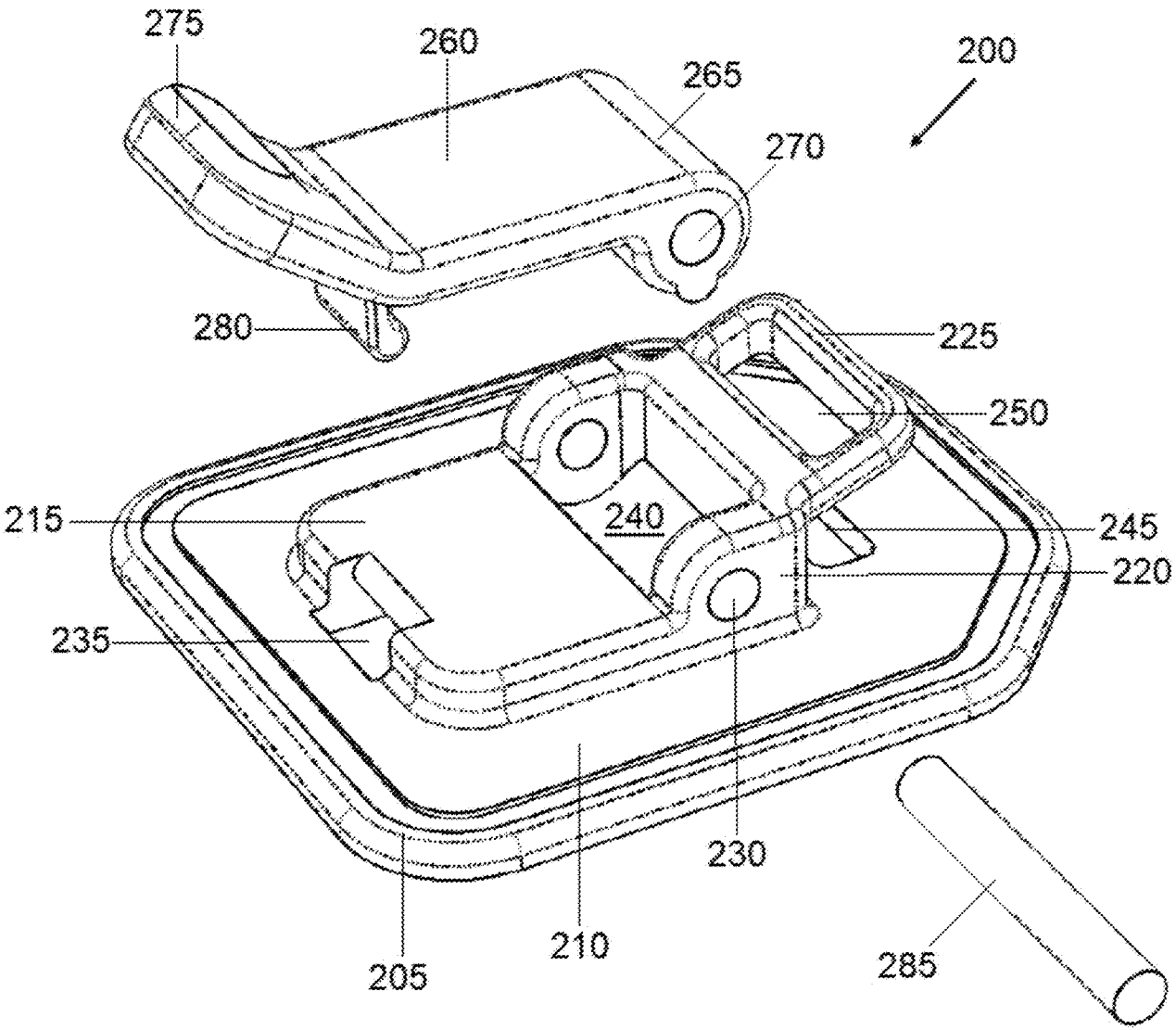
FIG. 5B is an exploded view of a clip assembly of a play yard.
Figure 5C:
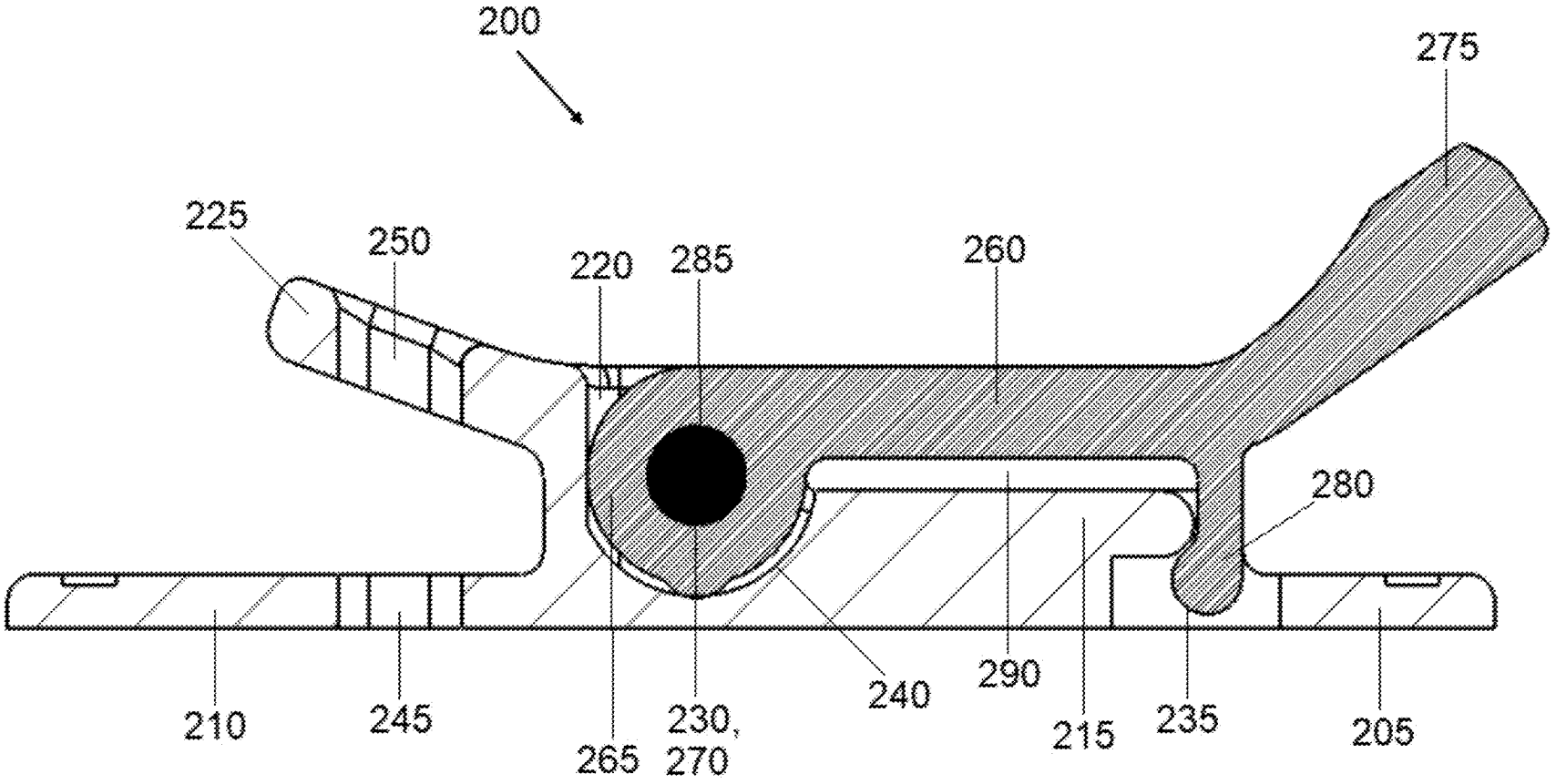
FIG. 5C is a cross-sectional view of a clip assembly of a play yard.

Details of the clip assembly 200 are illustrated in an isometric view, an exploded view, and a cross-sectional view in FIGS. 5A-5C, respectively. The clip assembly 200 includes three main pieces, a base portion 205, a leg 260, and a pin 285 that pivotally secures the leg 260 to the base 205. The base 205 includes a generally flat bottom portion 210, a raised plateau 215 extending upward from the bottom portion 210, raised side walls 220 extending upward from the bottom portion 210, and a loop portion 225 extending rearward and upward from the raised side walls 220. Apertures 230 are defined in the raised side walls 220. A detent retention aperture 235 is defined in the base portion 205 passing through a portion of the raised plateau 215 and at least a portion of or completely through the flat bottom portion 210 in front of the raised plateau 215. A cavity 240 having a rounded bottom is defined between the raised side walls 220, a front wall of the loop portion 225, and a rear of the raised plateau 215. In some embodiments, an aperture 245 is defined in the flat bottom portion 210, for example, beneath an opening 250 defined in the loop portion 225.

The leg 260 includes a rounded proximal end 265 that, in use, is disposed within the cavity 240 in the base portion 205. An aperture 270 passes through the rounded proximal end 265 of the leg 260. The pin 285 passes through the apertures 230 in the raised side walls 220 of the base portion 205 and through the aperture 270 in the proximal end 265 of the leg 260 to pivotally secure the proximal end 265 of the leg 260 in the cavity 240 and, more generally, to pivotally secure the leg 260 to the base portion 205. A distal end of the leg 260 forms a handle 275 that, in use, may be pushed or pulled on by a user to open or close the clip assembly 200. A detent 280 extends downward from a lower surface of leg 260 at or proximate to a base of the handle 275. In use, the detent 280 releasably snaps into the detent retention aperture 235 in the base portion 205 to hold the clip assembly 200 in a closed position. In the closed position, a cavity 290 is defined between a lower surface of the leg 260 and an upper surface of the raised plateau 215 of the base portion 205. As described in further detail below, a portion of the retention assembly 300 may be retained in the cavity 290 to releasably secure the clip assembly 200 and mattress 20 to the retention assembly 300 and floor 15A of the play yard 10. A user may pull on the handle 275 to pull the detent 280 out of engagement with the detent retention aperture 235 to open the clip assembly 200.

Figure 6:
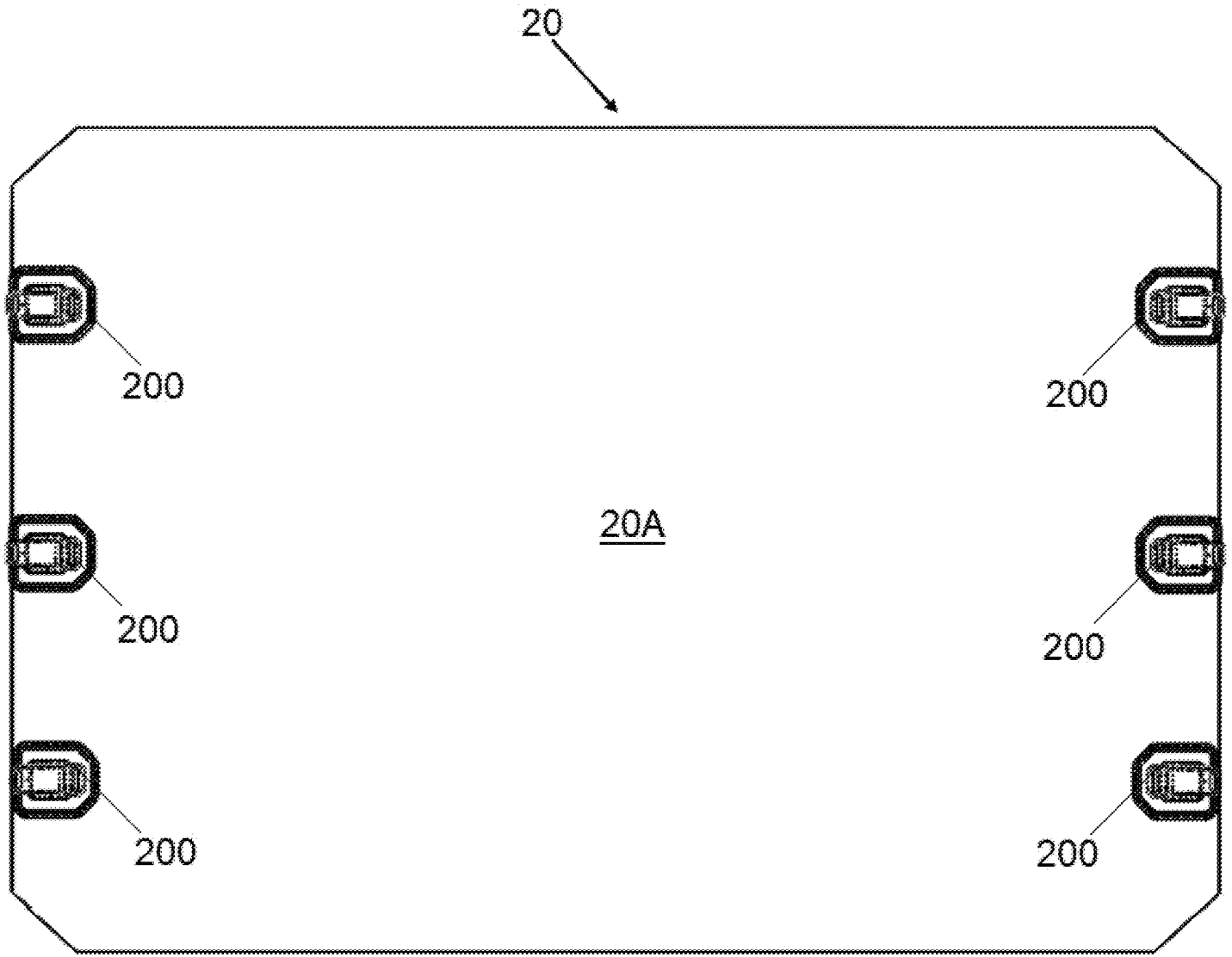
FIG. 6 illustrates a lower surface of an example of a mattress for a play yard.

One or more, for example, four or six or more clip assemblies 200 may be secured to a lower side of a mattress 20 for a play yard. FIG. 6, for example, illustrates a mattress 20 of a play yard having a lower side 20A to which six clip assemblies 200 are attached, with three clip assemblies 200 attached proximate each of two opposite ends of the mattress 20. In some examples, equal numbers of clip assemblies 200 may be disposed on opposite ends of a mattress 20 as illustrated in FIG. 6. In other example, different numbers of clip assemblies may be disposed on different ends of the mattress. In further examples one or more clip assemblies 200 may be disposed proximate or at edges of the long ends of the mattress 20, rather than the short ends as illustrated in FIG. 6, or on both the long and short ends.

The clip assemblies 200 may be secured to the mattress 20 by, for example, stitching or sewing the clip assemblies to the lower surface 20A of the mattress 20. The bottom portions 210 of the base portions 205 of the clip assemblies may be sufficiently thin and formed of a material that provides for stitching or threads to pass through the bottom portions 210 to stitch or sew the clip assemblies 200 to the mattress 20. In other embodiments an adhesive, for example, epoxy or plastic cement may be utilized to secure the clip assemblies 200 to the mattress 20. In further embodiments, the clip assemblies 200 may be secured to the mattress 20 by plastic welding or other forms of securing articles to one another known in the art.

The clip assemblies 200 may be formed of any material or materials suitable for performing their desired functions. In some embodiments, the base portion 205, leg 260, and pin 285 may be molded from an engineering plastic, for example, nylon or polyvinylchloride. In other embodiments, the pin 285 may be formed of a metal, for example, stainless steel.

Figure 7:
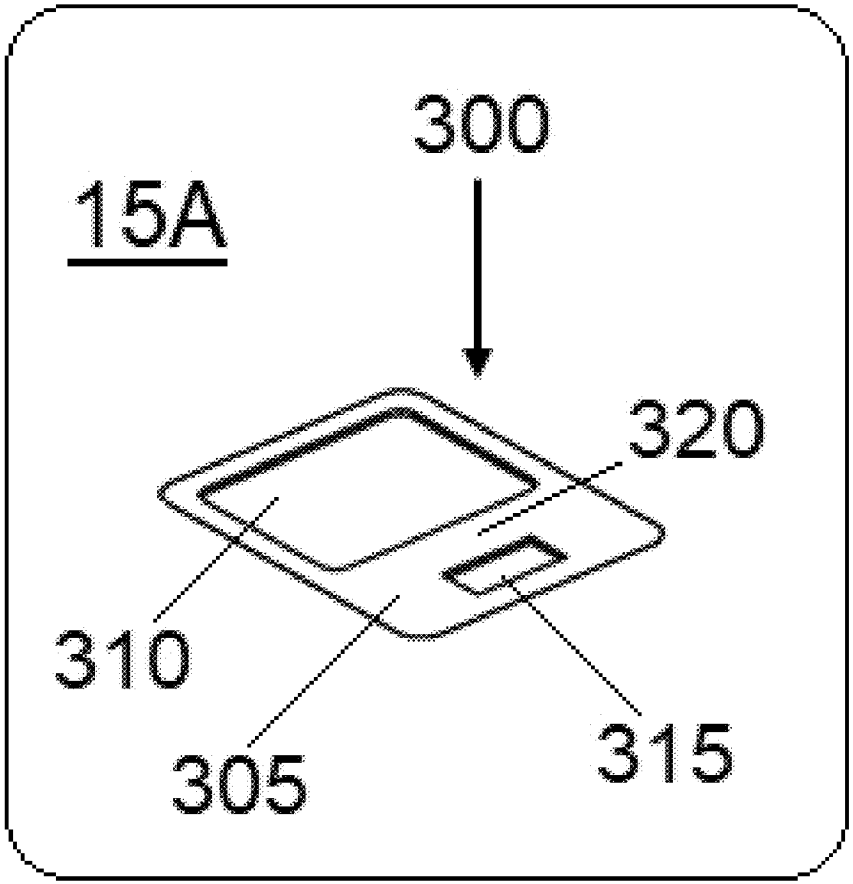
FIG. 7 illustrates an example of a retention assembly of a play yard.

An example of a retention assembly 300 is illustrated in FIG. 4 and in an enlarged view in FIG. 7. The retention assembly 300 includes a sheet or plate 305 of material, for example, nylon, polyethylene, polyvinylchloride, or another suitable material. The sheet or plate 305 is secured to the floor 15A of the play yard 10 by stitching or sewing, with an adhesive, or by plastic welding or other forms of securing articles to one another known in the art. In some examples, the sheet or plate 305 is formed integral with the floor 15A of the play yard 10. Two apertures, a first, larger aperture 310, and a second, smaller aperture 315 are defined in the sheet or plate 305. In other examples, the apertures 310, 315 may be of similar or the same size or one or more dimensions or the second aperture 315 may be larger than one or more corresponding dimensions of the first aperture 310. A central retention region 320 is defined between the apertures 310, 315.

Attachment of the clip assemblies 200 to the retention assemblies 300 and of the mattress 20 to the floor 15A of the play yard 10 is illustrated in FIGS. 8A-8I. In various of these figures the mattress 20 and details of the frame 100 and other portions of the play yard 10 are omitted for clarity.

Figure 8A:
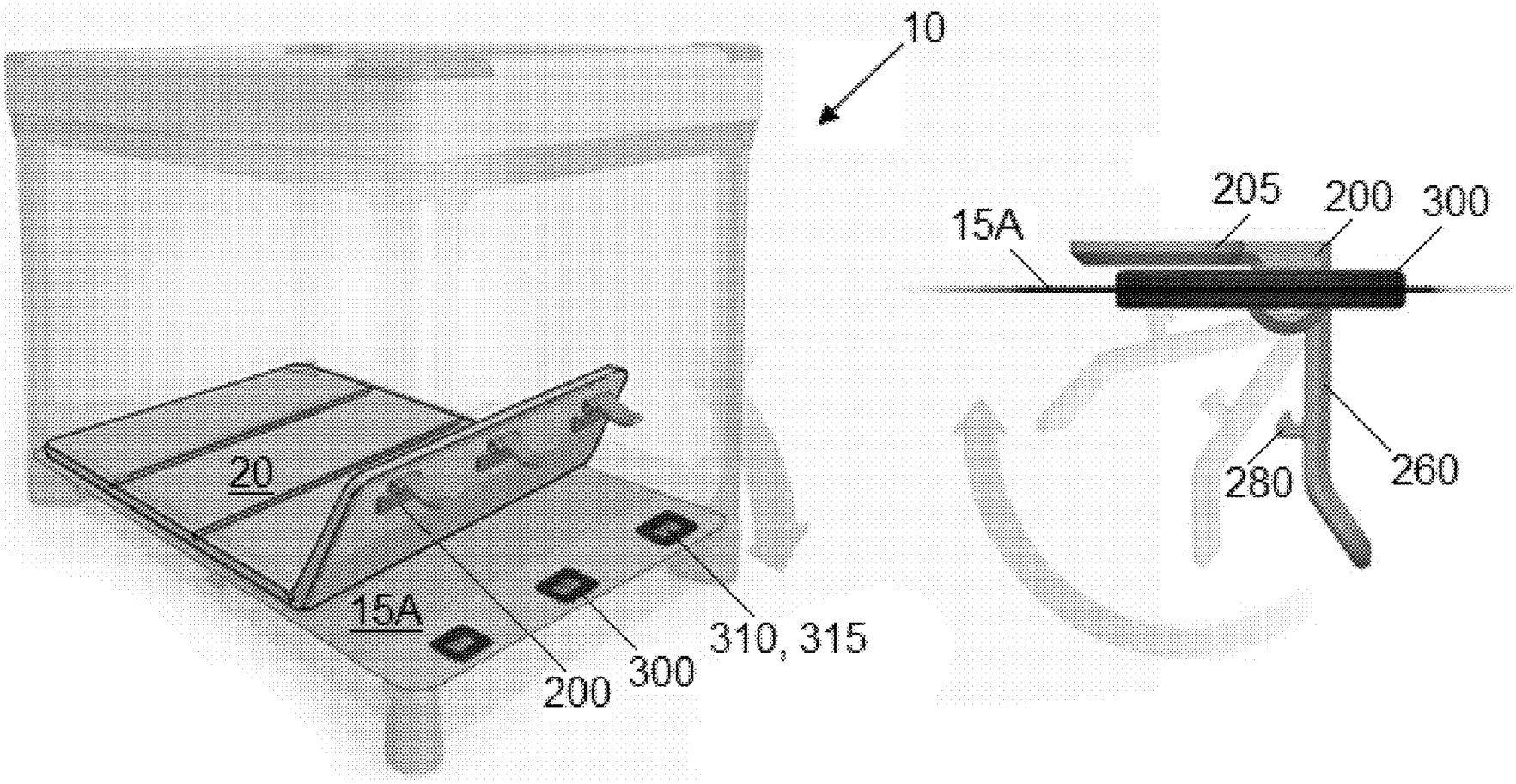
FIGS. 8A-8I illustrate acts in attaching a mattress to a floor of a play yard.

Attachment of the clip assemblies 200 to the retention assemblies 300 and of the mattress 20 to the floor 15A of the play yard 10 is illustrated generally in FIG. 8A. Not all features are illustrated or labelled in FIG. 8A for the sake of clarity. For example, only one aperture in the retention assemblies 300 are illustrated in FIG. 8A although it is to be understood that two apertures would typically be present as described elsewhere in this disclosure. One first places the mattress 20 on the floor 15A of the play yard 10. A side of the mattress 20 including the clip assemblies 200, in open configurations, is lowered toward the floor 15A of the play yard 10. The legs 260 of the clip assemblies 200 pass through the first apertures 310 in the retention assemblies 300 from an upper side to a lower side of the floor 15A. The legs 260 of the clip assemblies 200 are then rotated into a closed position in which the detents 280 pass through the second apertures 315 in the retention assemblies 300 from the lower side of the floor 15A to the upper side f the floor 15A, and snap into the detent retention apertures 235 in the base portions 205 of the clip assemblies 200. The central retention regions 320 of the retention assemblies 300 are trapped in the cavities 290 defined between the lower surfaces of the legs 260 and the upper surfaces of the raised plateaus 215 of the base portions 205. Although FIG. 8A illustrates only three clip assemblies 200 and retention assemblies 300 on one end of the mattress 20 and floor 15A, it is to be appreciated that other examples may include different numbers of clip assemblies 200 and retention assemblies 300 on alternative or additional ends of the mattress 20 and floor 15A.

Figure 8B:
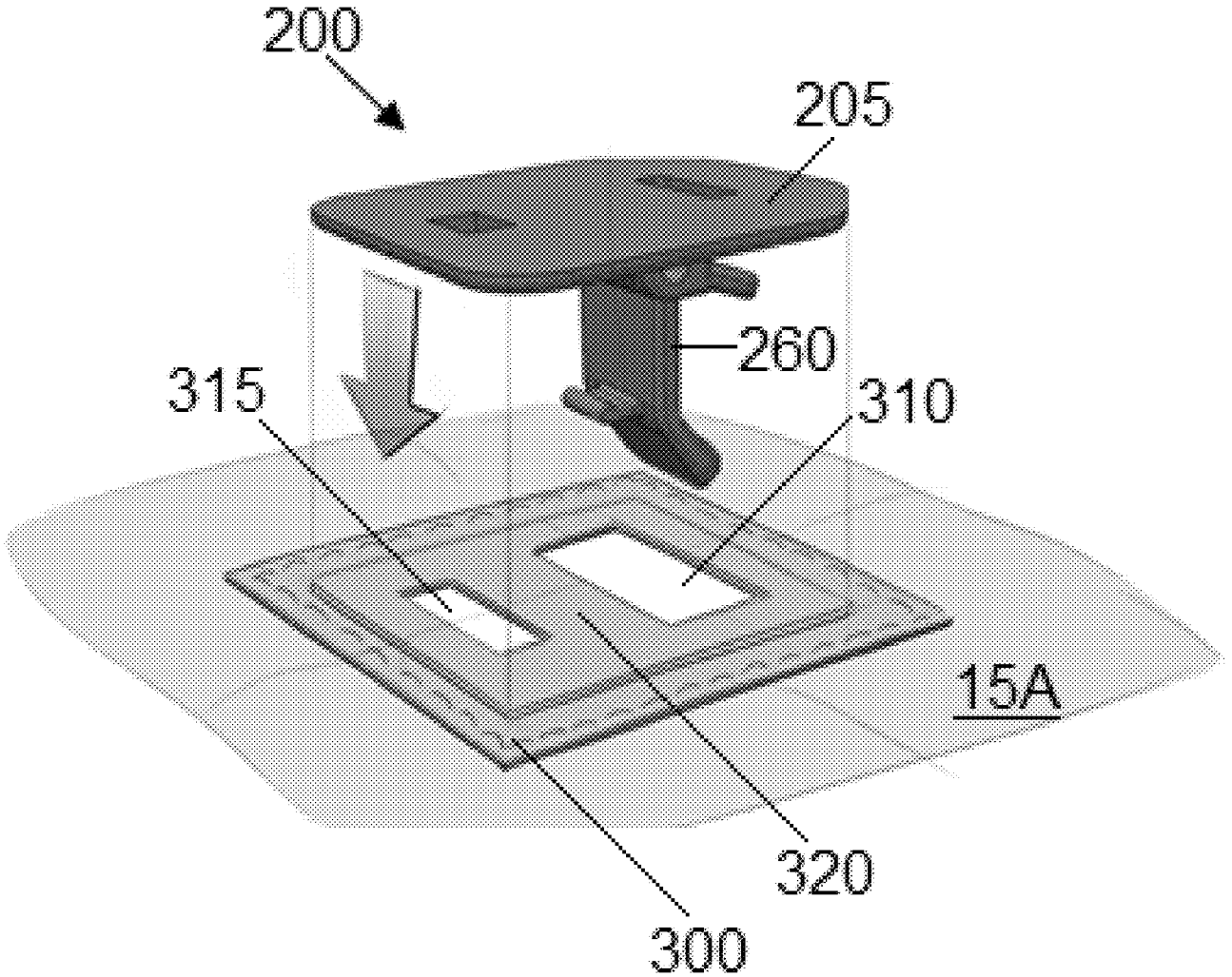
Figure 8C:
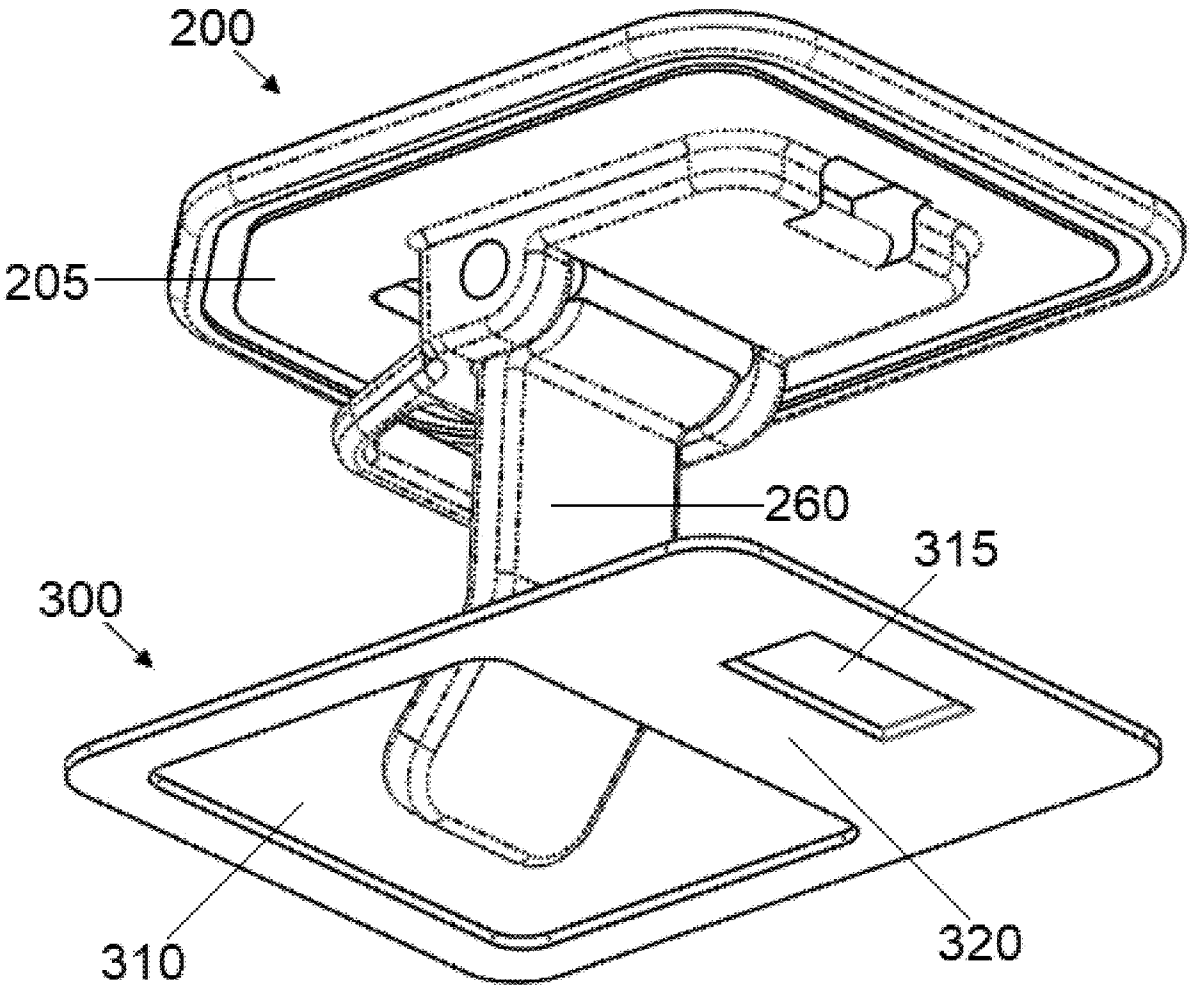
Figure 8D:
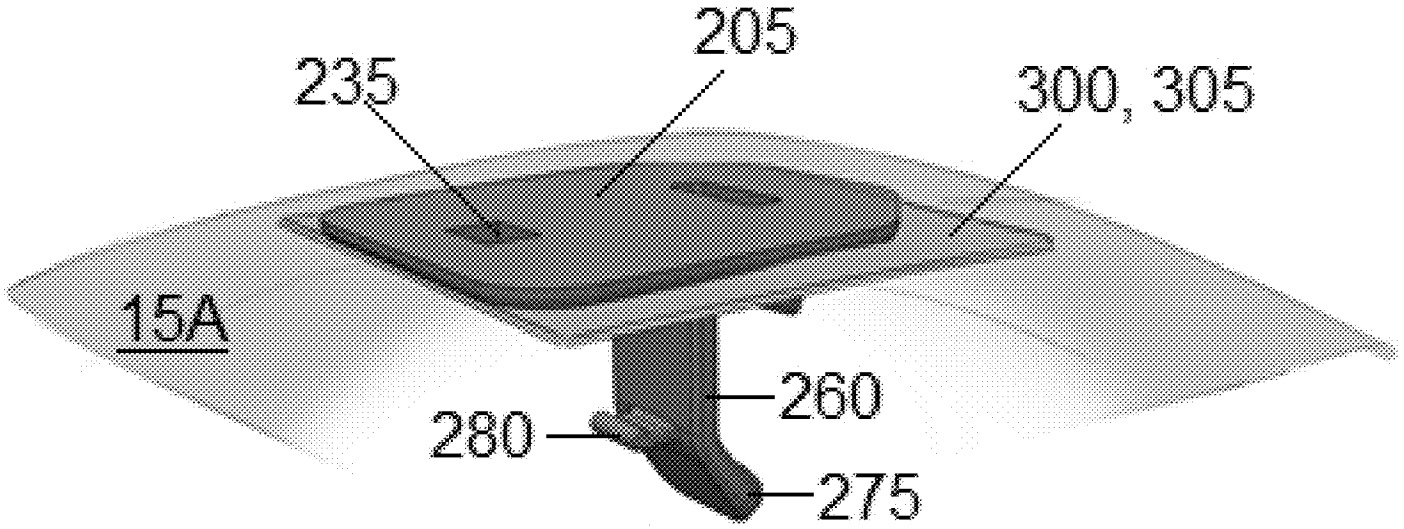
Figure 8E:
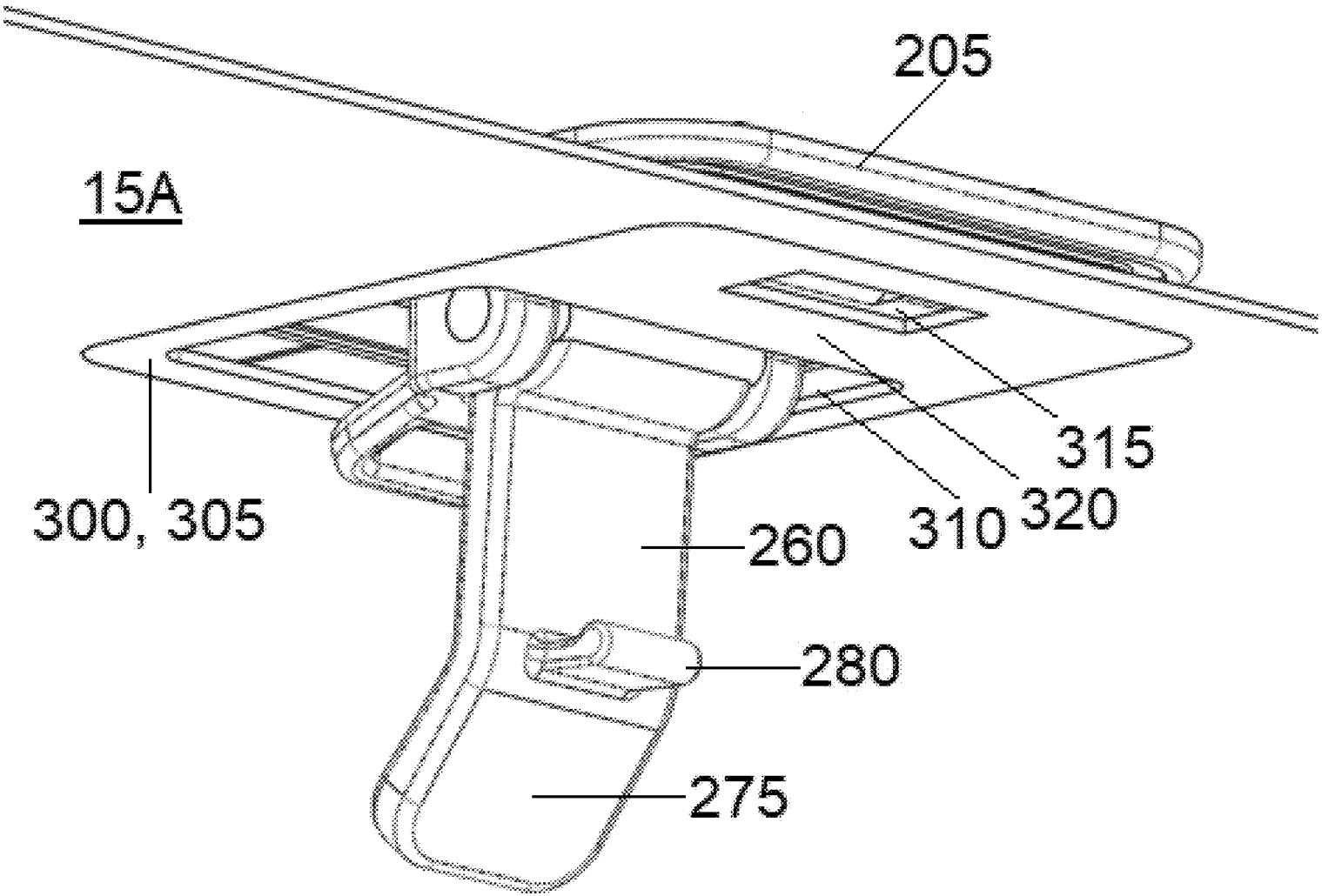
Figure 8F:
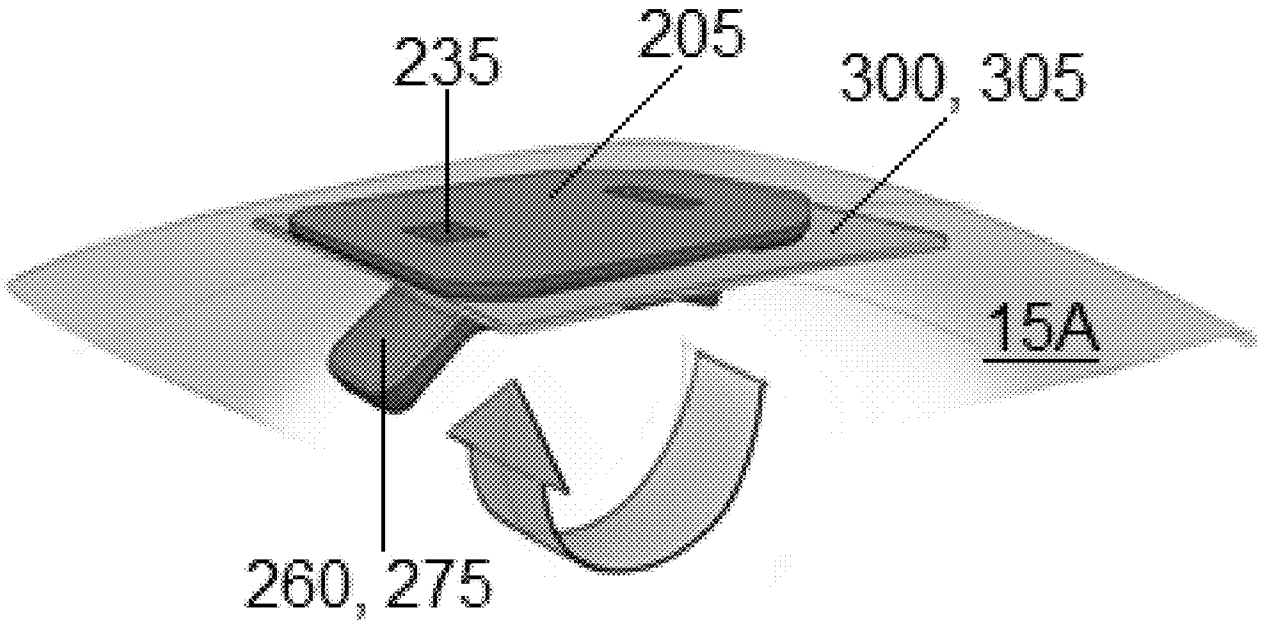
Figure 8G:
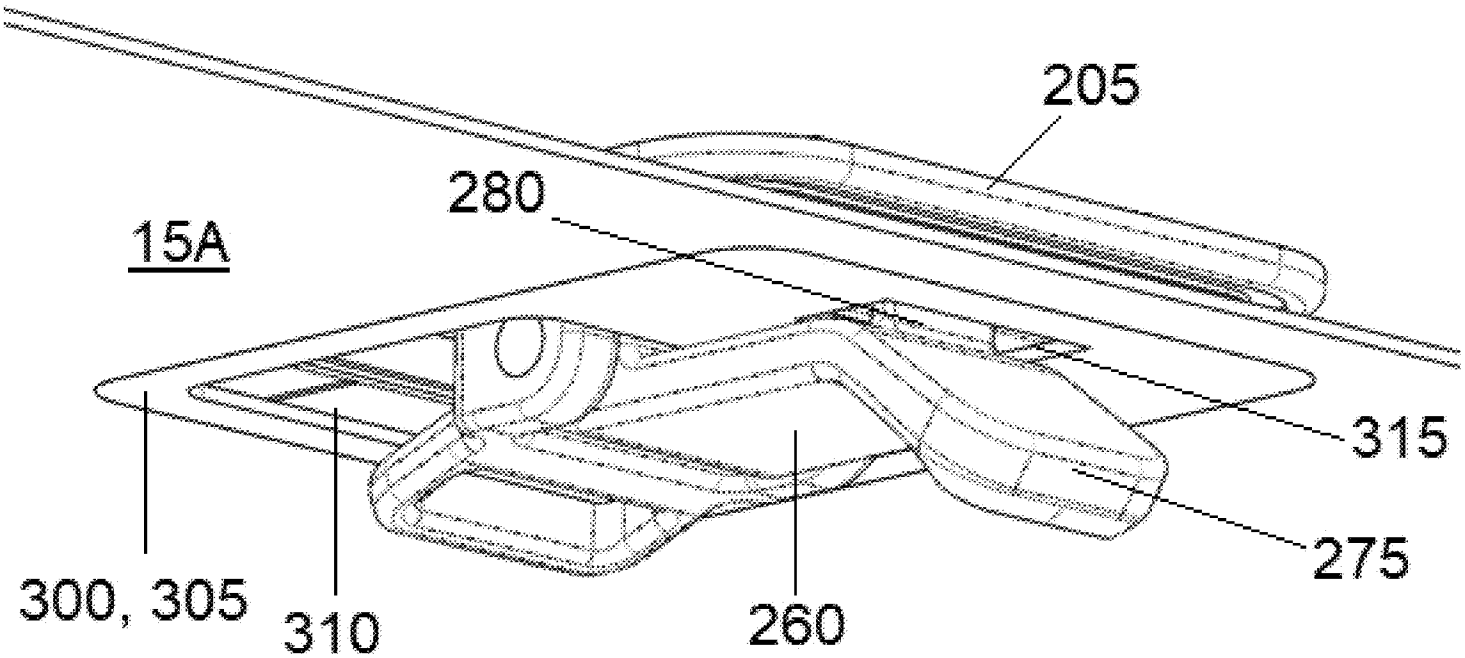
Figure 8H:
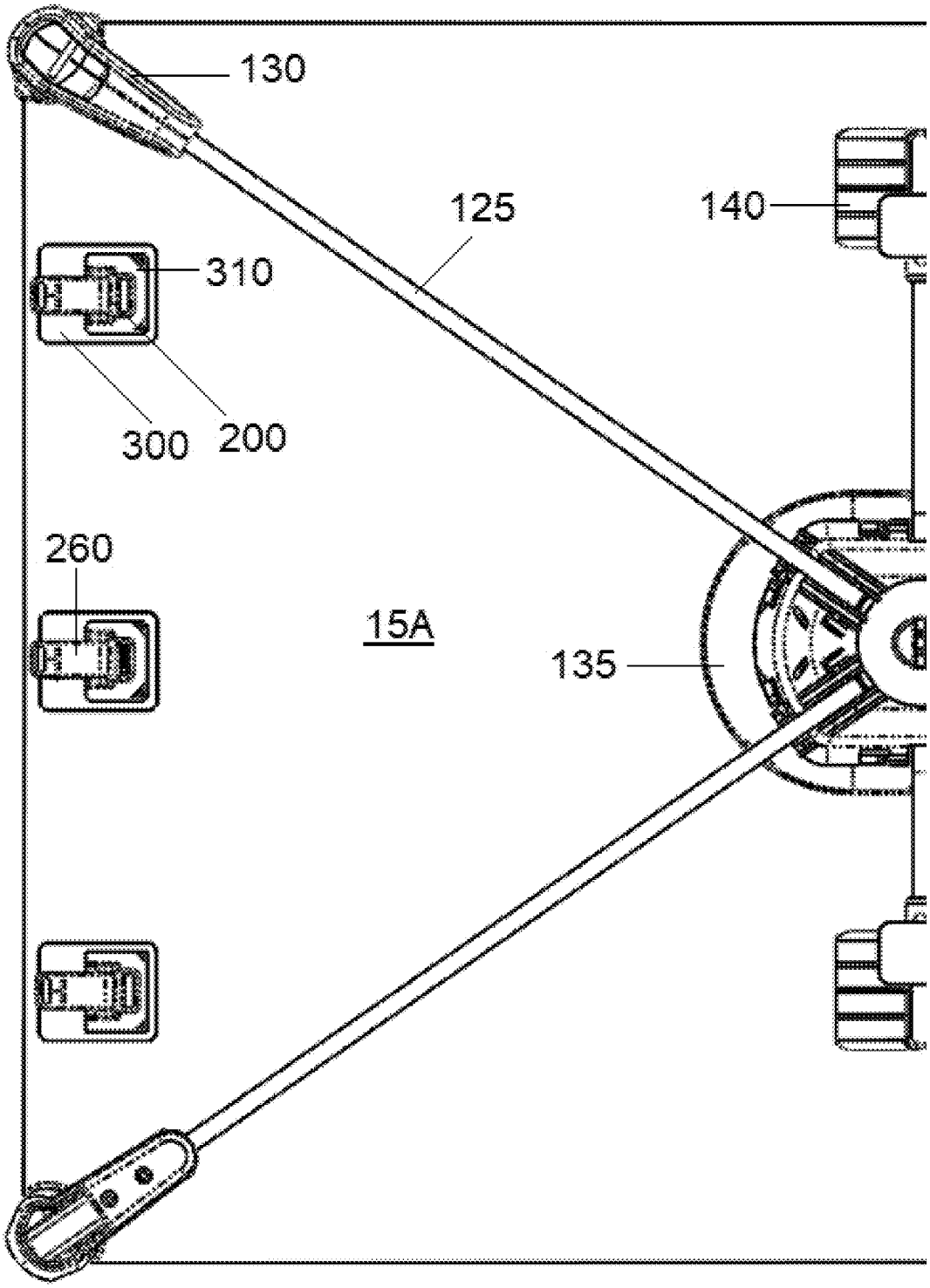
Figure 8I:
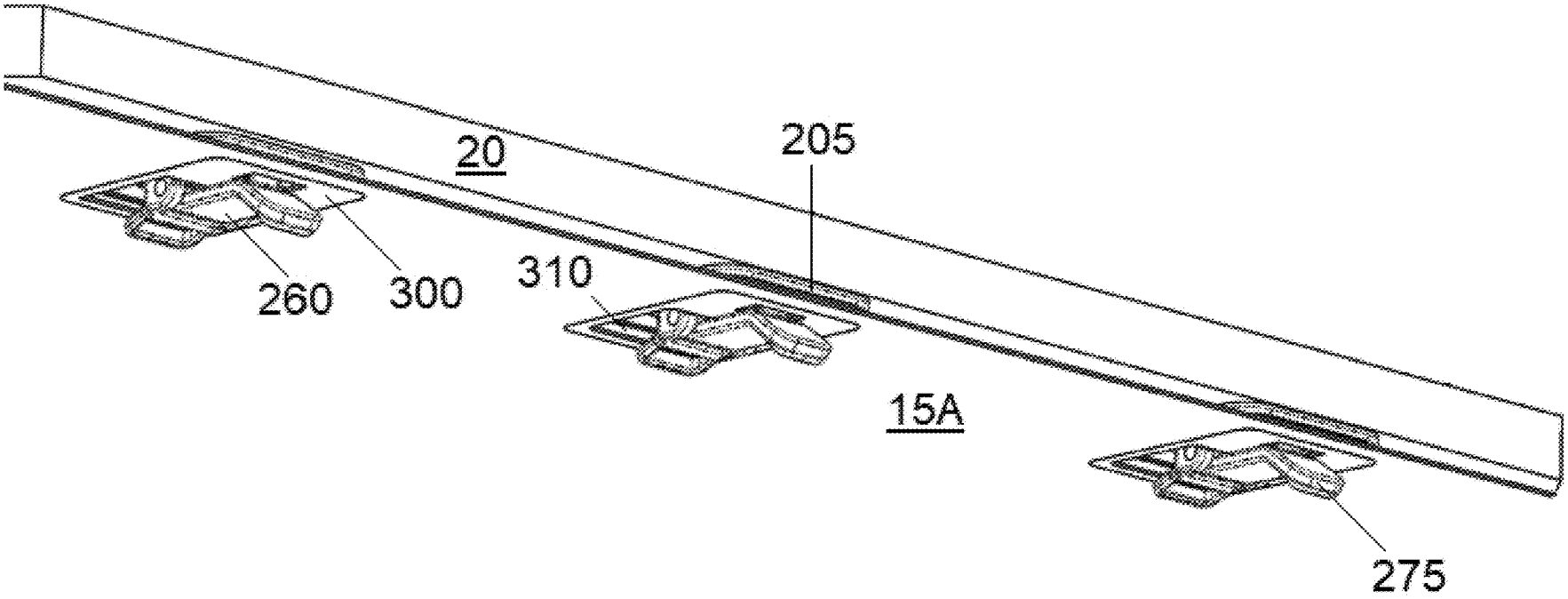

A more detailed illustration of passing the leg 260 of a clip assembly 200 pass through the first aperture 310 in a retention assembly 300 is illustrated in FIGS. 8B and 8C from upper and lower sides, respectively. A more detailed illustration of a configuration of a clip assembly 200 and retention assembly after passing the leg 260 of a clip assembly 200 pass through the first aperture 310 in a retention assembly 300 is illustrated in FIGS. 8D and 8E from upper and lower sides, respectively. The floor 15A in FIG. 8D is illustrated being partially transparent to illustrate the leg 260 of the clip assembly 200. A more detailed illustration of a configuration of a clip assembly 200 and retention assembly after the leg 260 of a clip assembly 200 is snapped into a closed configuration is illustrated in FIGS. 8F and 8G from upper and lower sides, respectively. The floor 15A in FIG. 8F is illustrated being partially transparent to illustrate the leg 260 of the clip assembly 200. The mattress 20 is not illustrated in FIG. 8G for clarity. An illustration of an end of a mattress 20 coupled to a floor 15A of a play yard 10 with three clip assemblies 200 and retention assemblies is illustrated in a bottom view and a perspective view in FIGS. 8H and 8I, respectively.

Figure 9:
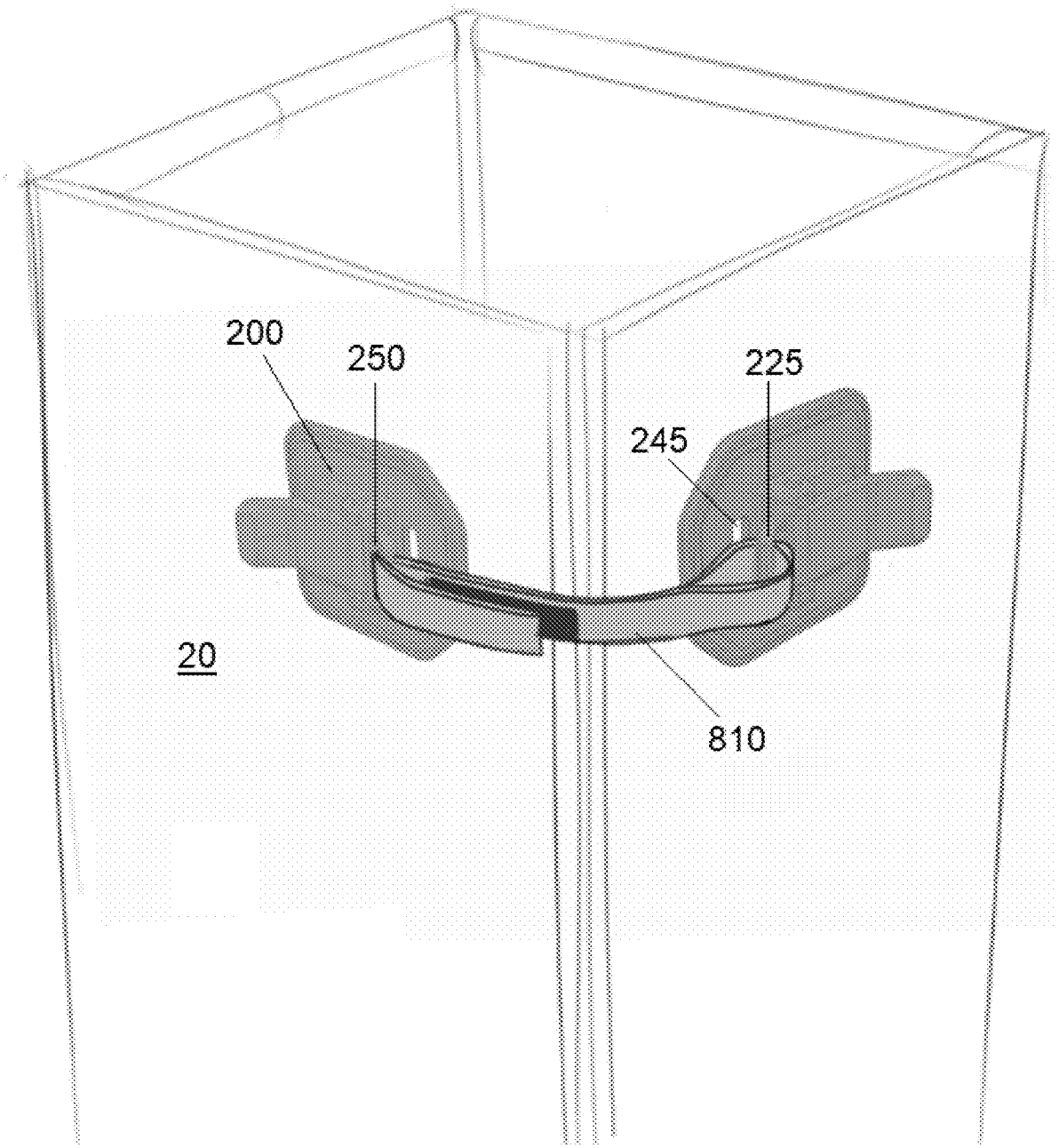
FIG. 9 illustrates an example of a mattress of a play yard in a folded configuration.

To detach the mattress 20 from the floor 15A of the play yard 10, one would perform the steps used to attach the mattress 20 from the floor 15A of the play yard 10 in reverse order. One would pull on the handles 275 of the legs 260 of the clip assemblies 200 to pull the detents 280 out of the detent retention apertures 235 in the base portions 205 and though the apertures 315 in the retention assemblies 300 and free the central retention regions 320 of the retention assemblies 300 from the clip assemblies 200. One would then lift the mattress 20 from the floor 15A of the play yard 10 with the open legs 260 of the clip assemblies 200 passing through the apertures 310 in the retention assemblies 300. Once the mattress 20 is free of the floor 15A of the play yard 10 it can be folded up, for example, around the collapsed frame 100 of the play yard 10 for storage or transport. As illustrated in FIG. 9 one or more ties or hook and loop fasteners 810 may be passed through the openings 250 in the loop portions 225 and/or apertures 245 in the clip assemblies 200 to hold the mattress 20 in the folded state.

Figure 10:
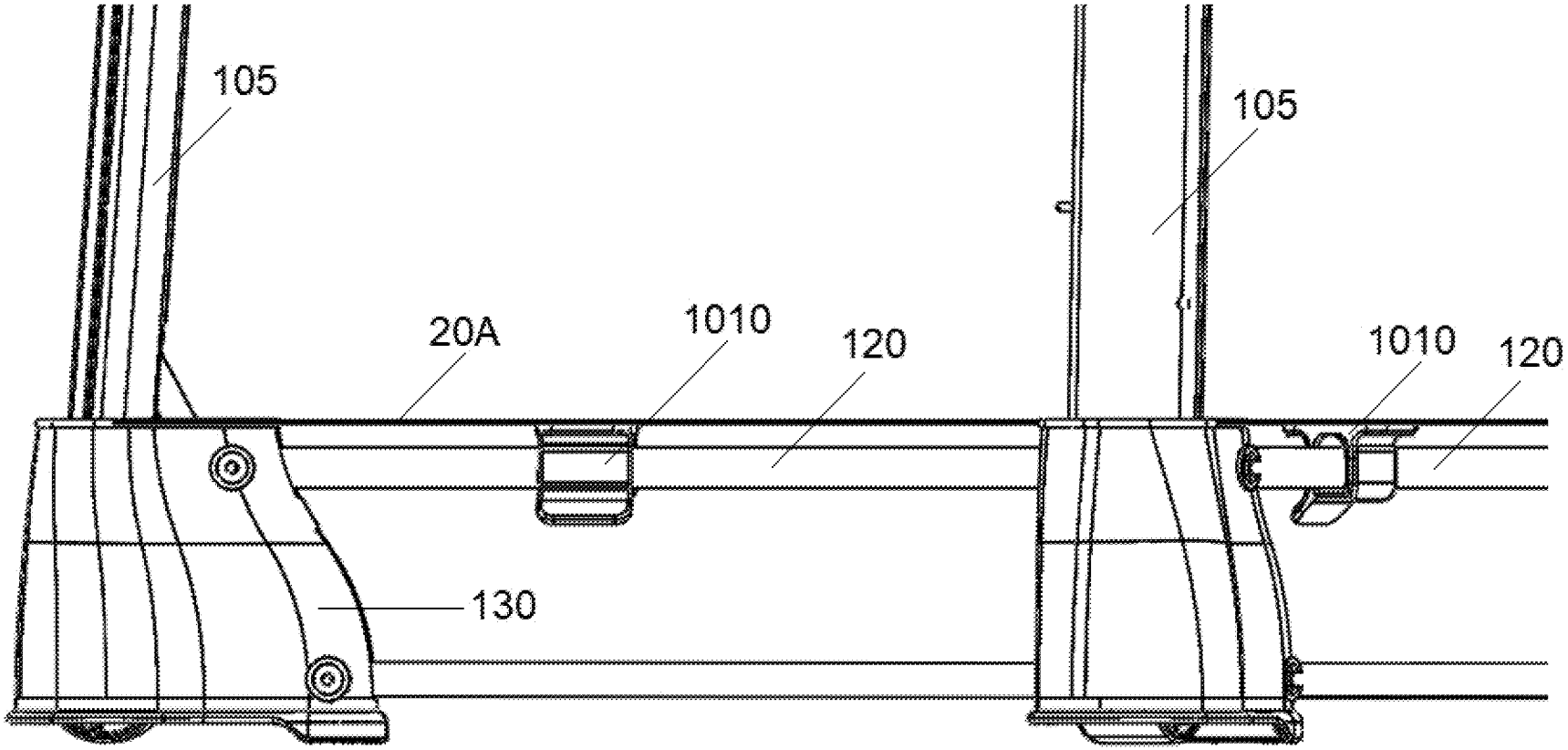
FIG. 10 illustrates an example of clips securing a mattress to the frame of a play yard.
Figure 11:
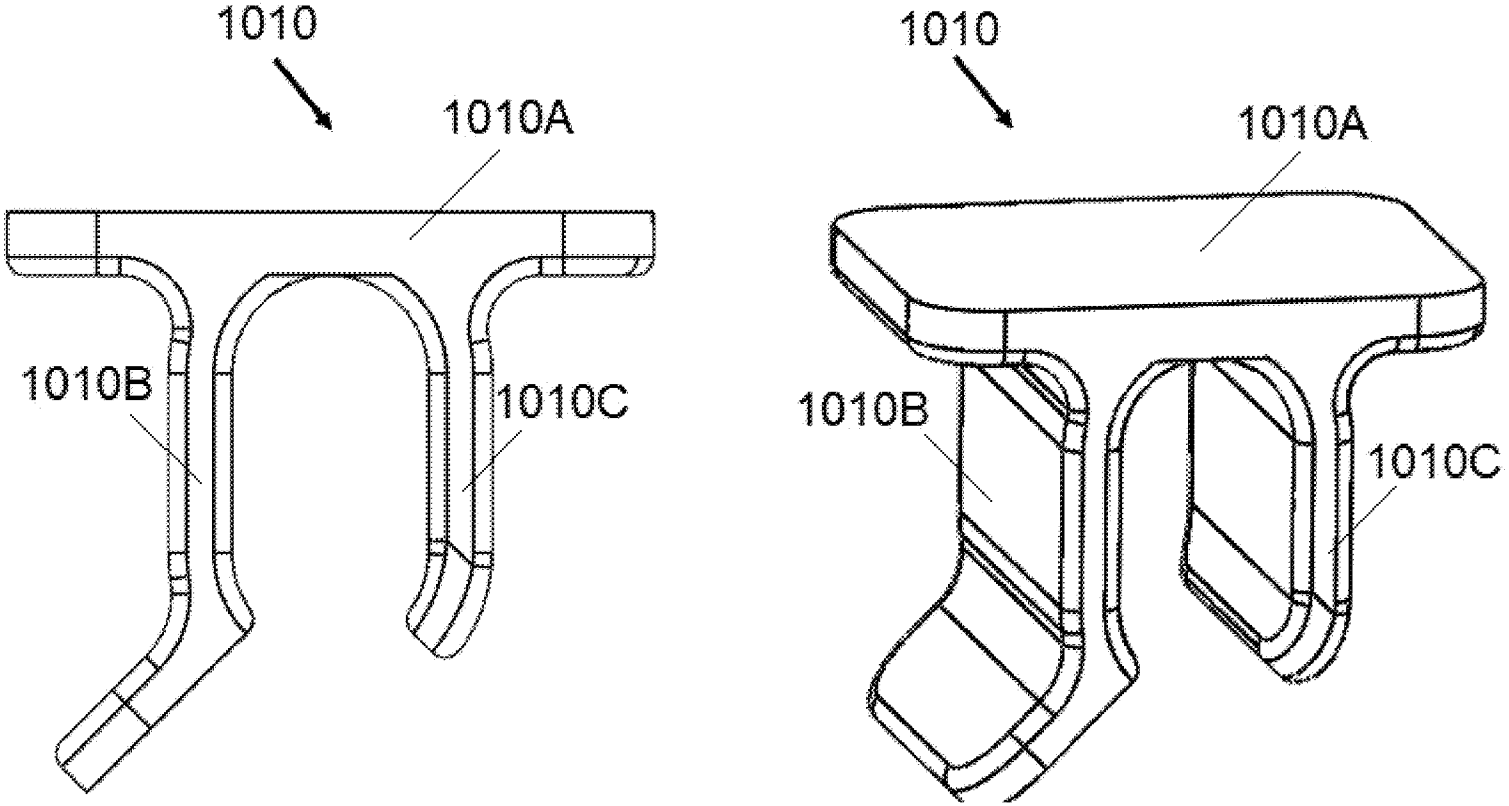
FIG. 11 illustrates the clips of FIG. 10 in further detail.

In another example, a mattress of a play yard may be removably secured to the frame of the play yard with one or more clips. As illustrated in FIG. 10, one or more clips 1010 may be secured to a lower side 20A of a mattress for a play yard. The clips 1010 may be removably coupled to one or more frame members, for example, the lower fourbar tops 120 of the play yard frame 100. Only the lower surface 20A of the mattress, rather than the entire mattress is illustrated in FIG. 10 for clarity. FIG. 11 illustrates examples of the clips 1010 from a side and isometric view. The clips 1010 include a base 1010A and two legs 1010B, 1010C extending from the base 1010A. The clips 1010 may be formed of a flexible plastic material so that the clips 1010 may be snapped on to or pulled from the frame member of the play yard with the frame member being disposed in spaces defined between the bases 1010A and legs 1010B, 1010C when the clips 1010 are secured to the frame member.

Figure 12:
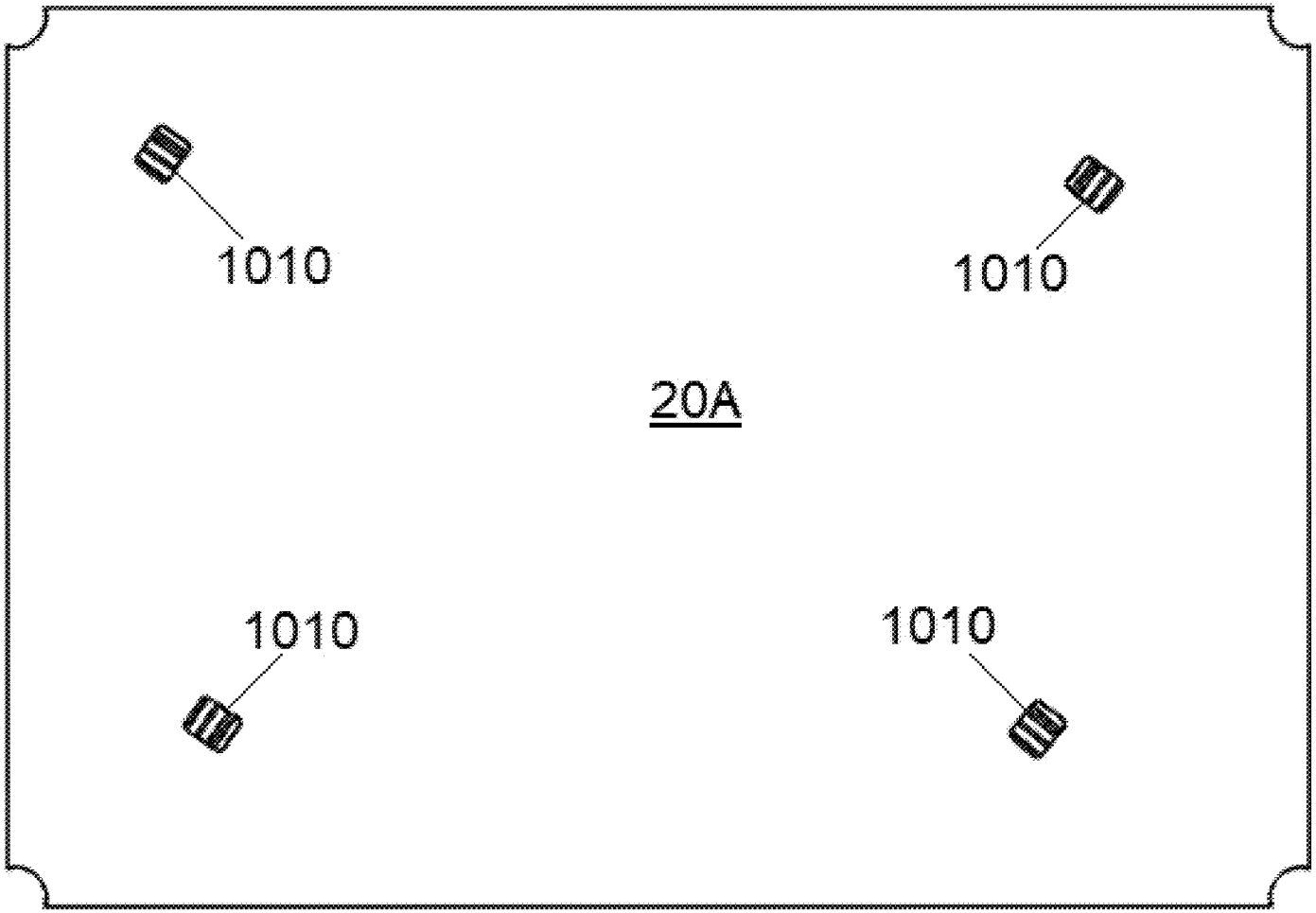
FIG. 12 illustrates an example of placement of the clips of FIG. 10 on the underside of a mattress of a play yard.

FIG. 12 illustrates one example of an arrangement of four clips 1010 on the lower side 20A of a mattress for a play yard. The clips 1010 may be secured to the lower side 20A of the mattress by stitching or sewing, with an adhesive, or by plastic welding or other forms of securing articles to one another known in the art.

Figure 13:
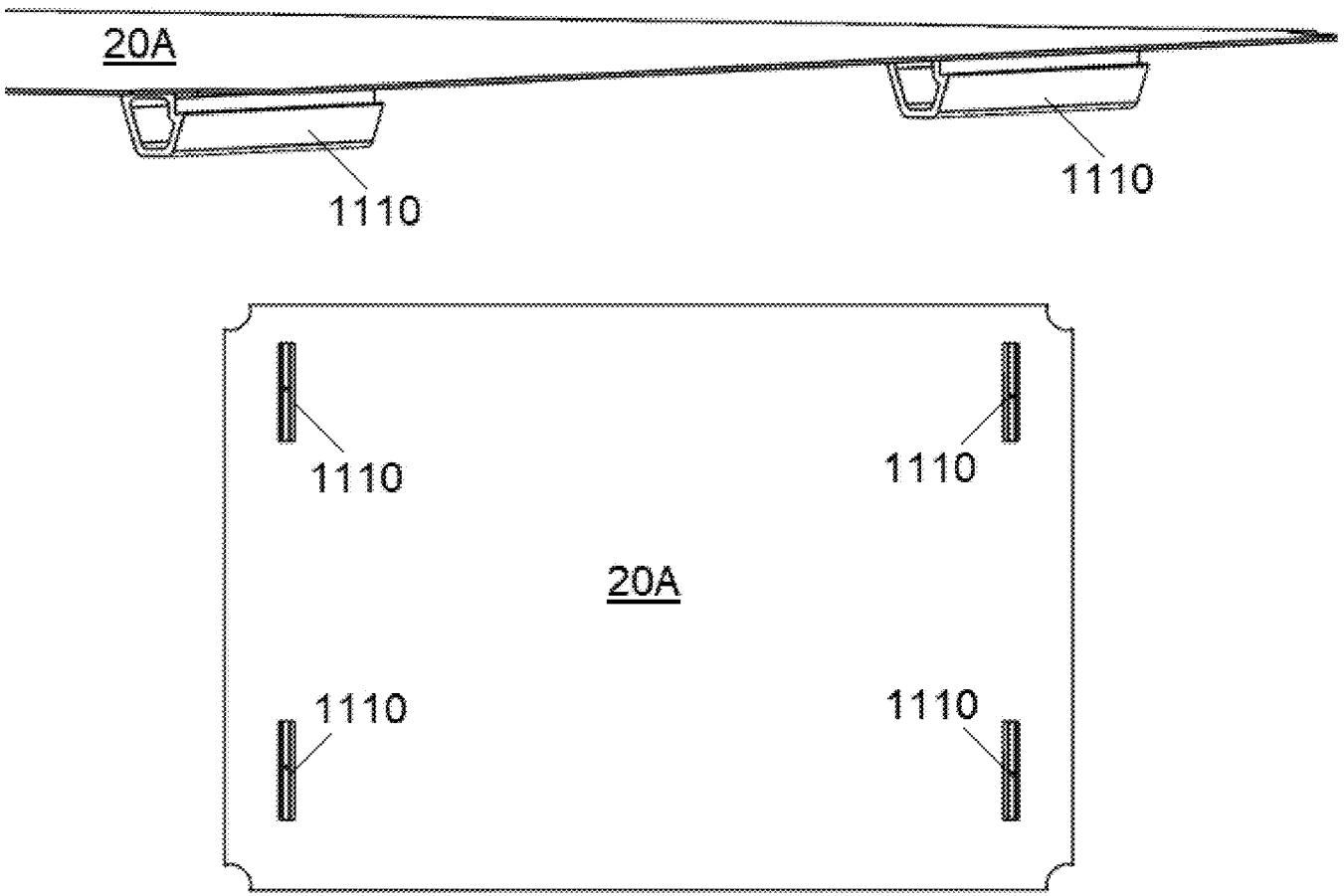
FIG. 13 illustrates an example of extrusions coupled to a lower surface of mattress of a play yard.

In another example, a mattress of a play yard may be removably secured to the frame of the play yard with one or more extrusions coupled to a lower surface of the mattress that removably couple to one or more respective extrusion receiving clips mounted to one or more frame members, for example, the lower fourbar tops 120 of the play yard frame 100. FIG. 13 illustrates examples of extrusions 1110 coupled to a lower surface 20A of mattress of a play yard and how they might be arranged on the lower surface 20A of the mattress. Only the lower surface 20A of the mattress, rather than the entire mattress is illustrated. The extrusions 1110 may be secured to the lower side 20A of the mattress by stitching or sewing, with an adhesive, or by plastic welding or other forms of securing articles to one another known in the art.

Figure 14A:
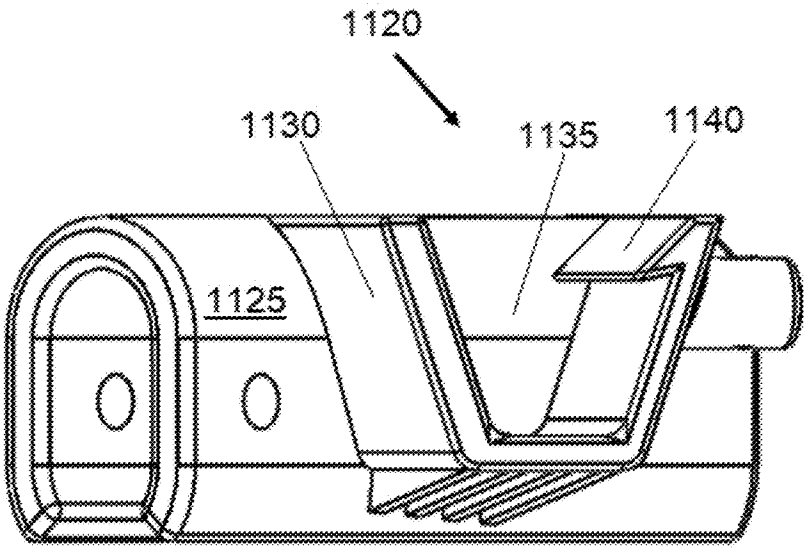
FIG. 14A illustrates an extrusion receiving clip that may be mounted on the frame members of a play yard frame to receive and retain the extrusions of FIG. 13.
Figure 14A:
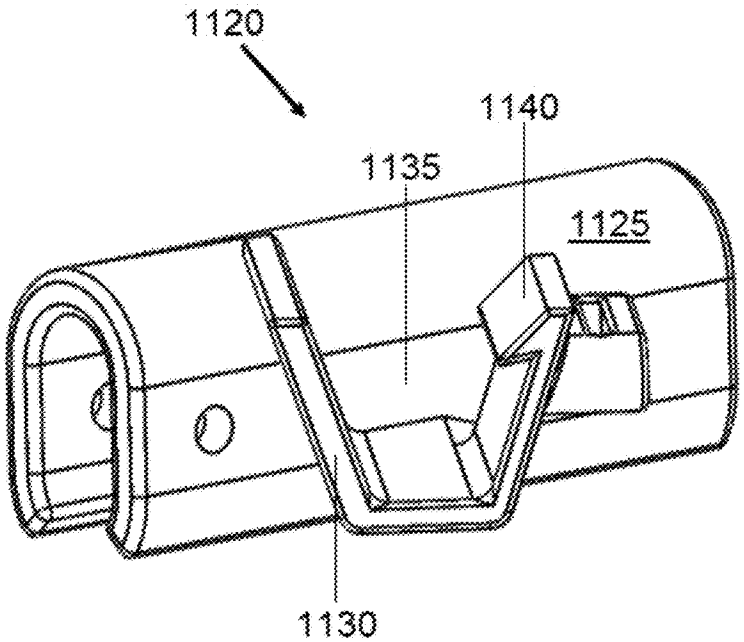
Figure 14B:
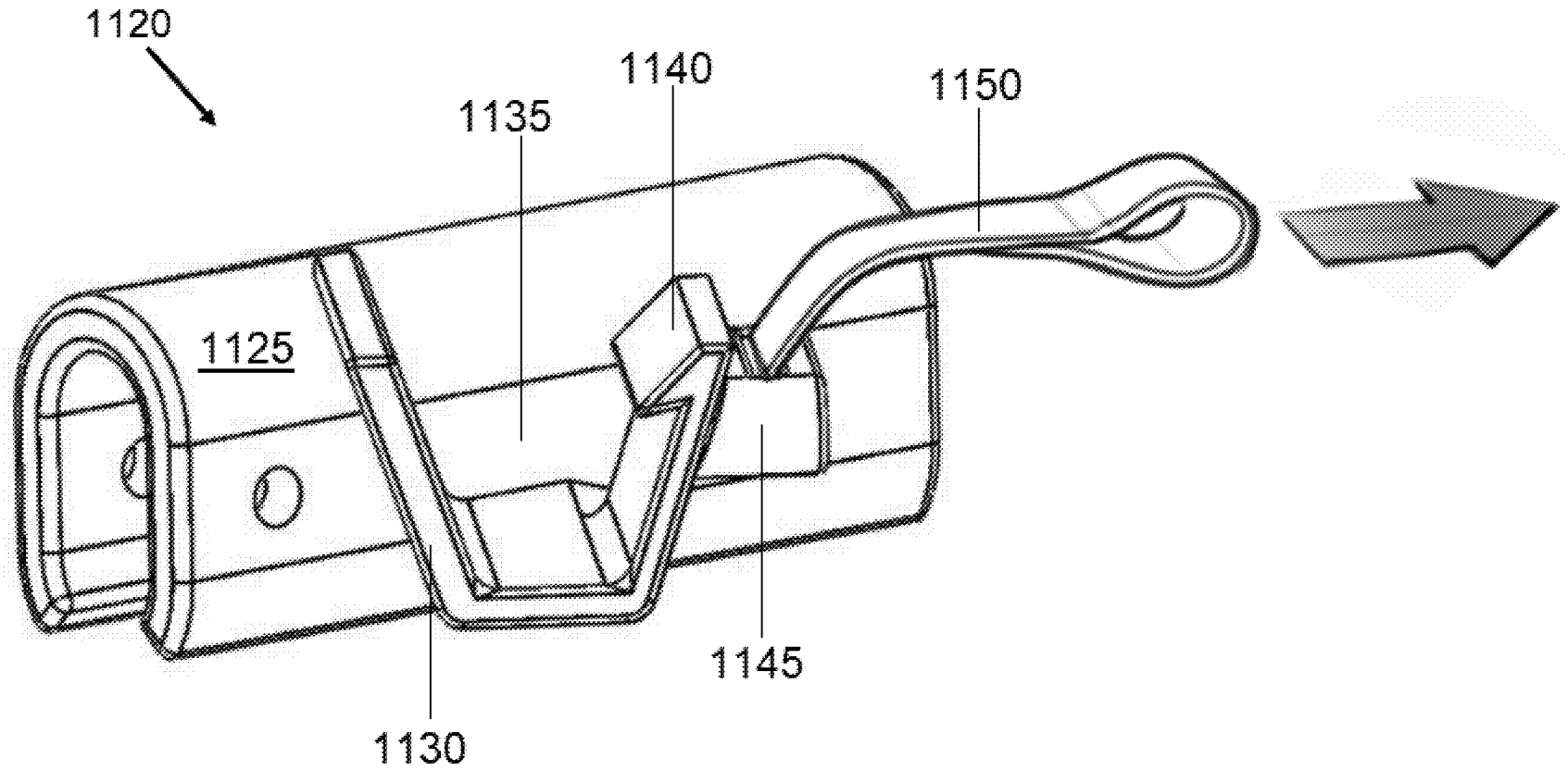
FIG. 14B illustrates an example of an extrusion receiving clip including an extrusion release pull strap.

FIG. 14A presents two views of an extrusion receiving clip 1120 that may be mounted on the frame members of the play yard frame to receive and retain the extrusions 1110 coupled to the lower surface 20A of the mattress. The extrusion receiving clip 1120 includes a body 1125 that fits around and couples the extrusion receiving clip 1120 to the frame member. Retention walls 1130 extend from the body 1125 and define a cavity 1135 for receiving and retaining an extrusion 1110. The retention walls 1130 also define a tooth 1140 that removably holds the extrusion 1110 in place within the cavity 1135. The tooth 1140 may interface with a protrusion 1145 (See FIG. 16A) extending from a main body of an extrusion 1110 to removably hold the extrusion 1110 in place within the cavity 1135. The walls 1130 may be formed of a material, for example, nylon or another engineering plastic, that is flexible enough to provide for a user to manually displace the tooth 1140 to remove the extrusion 1110 from the cavity 1135. In some embodiments, for example, as illustrated in FIG. 14B, the clip 1120 may feature a loop 1145 that attaches to a soft goods strap 1150 which allows the user to release the extrusion 1110 from the cavity 1135 by pulling on the strap 1150.

Figure 15:
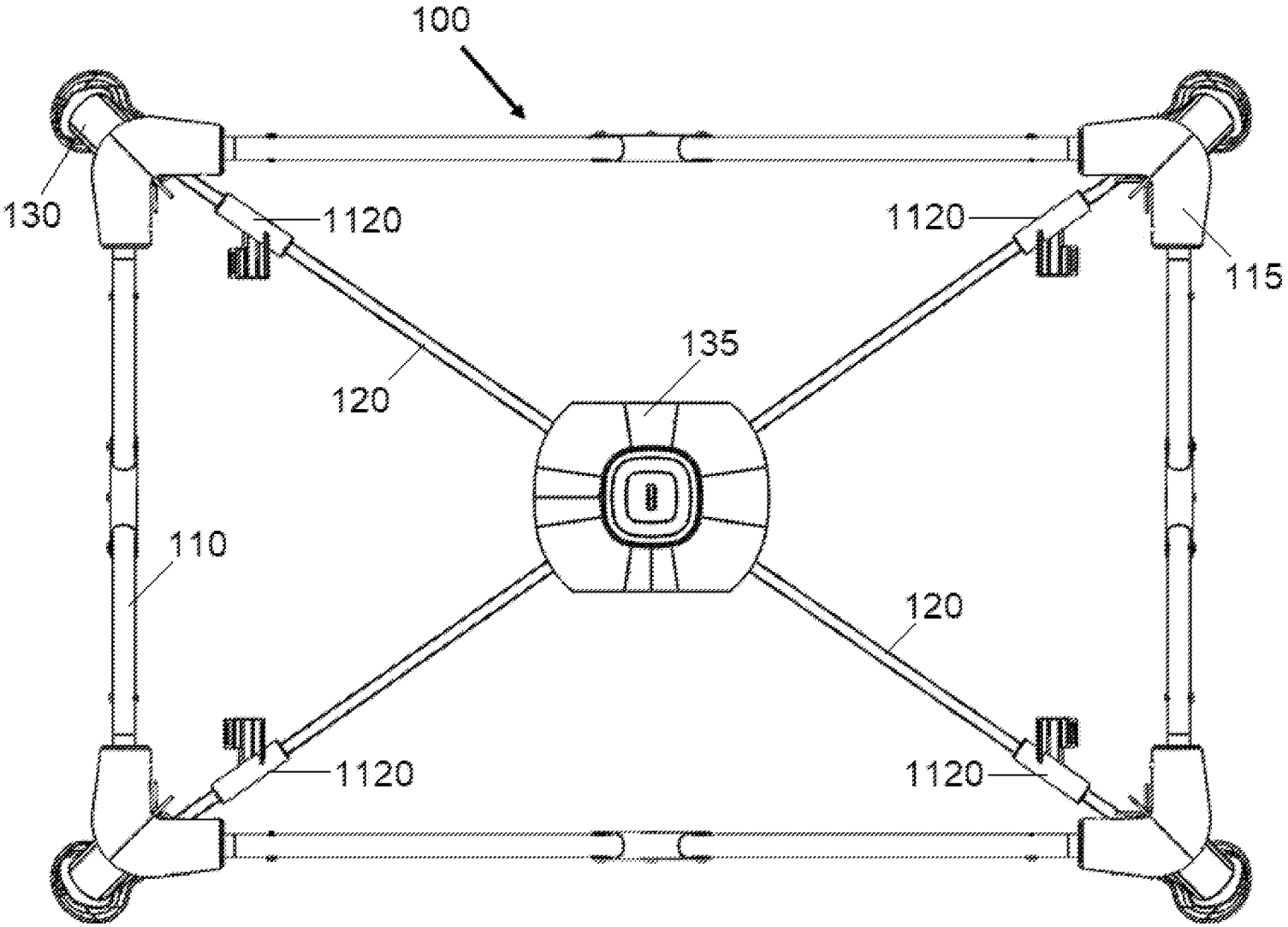
FIG. 15 illustrates an example of placement of extrusion receiving clips as illustrated in FIG. 14A on frame members of a play yard.
Figure 16A:
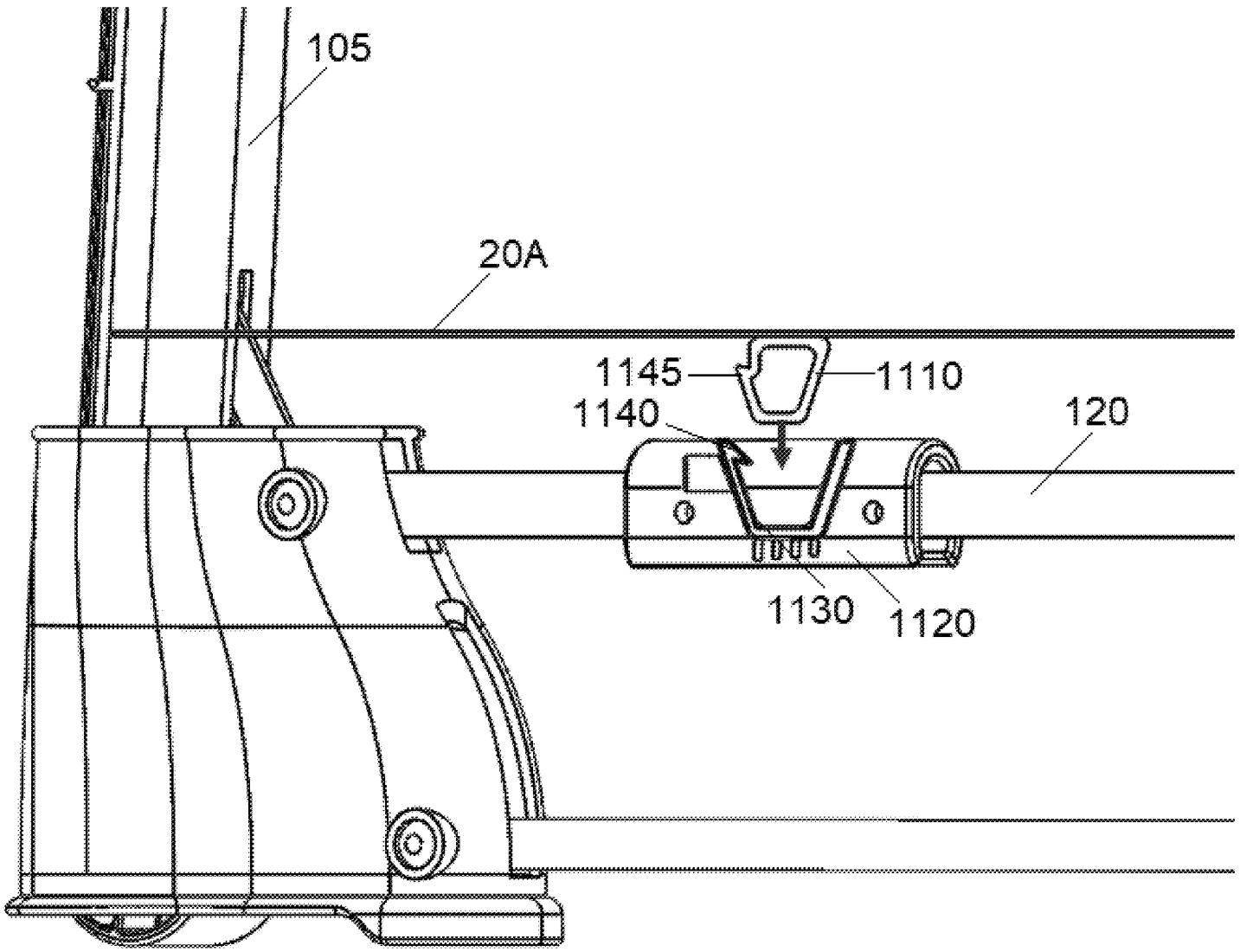
FIG. 16A illustrates insertion of an extrusion as illustrated in FIG. 13 into an extrusion receiving clip as illustrated in FIG. 14A.
Figure 16B:
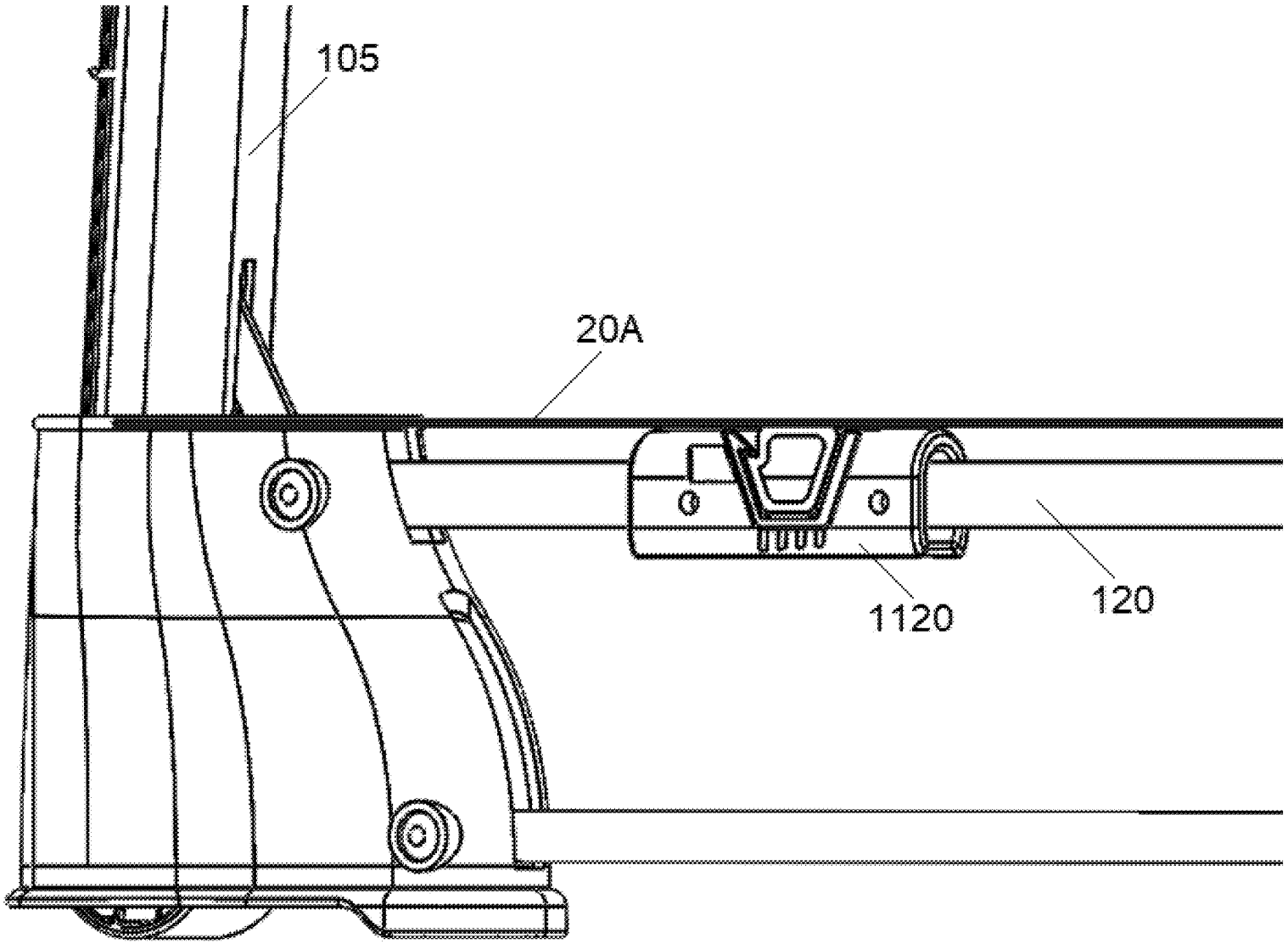
FIG. 16B illustrates an extrusion as illustrated in FIG. 13 mounted in an extrusion receiving clip as illustrated in FIG. 14A.

FIG. 15 illustrates how multiple, for example four, extrusion receiving clips 1120 may be mounted to frame members, for example, lower fourbar tops 120 of a play yard frame 100. FIGS. 16A and 16B illustrate an extrusion 1110 coupled to a lower surface 20A of a mattress being inserted into and retained in an extrusion receiving clip 1120 coupled to a frame member 120 of a play yard.

Figure 17:
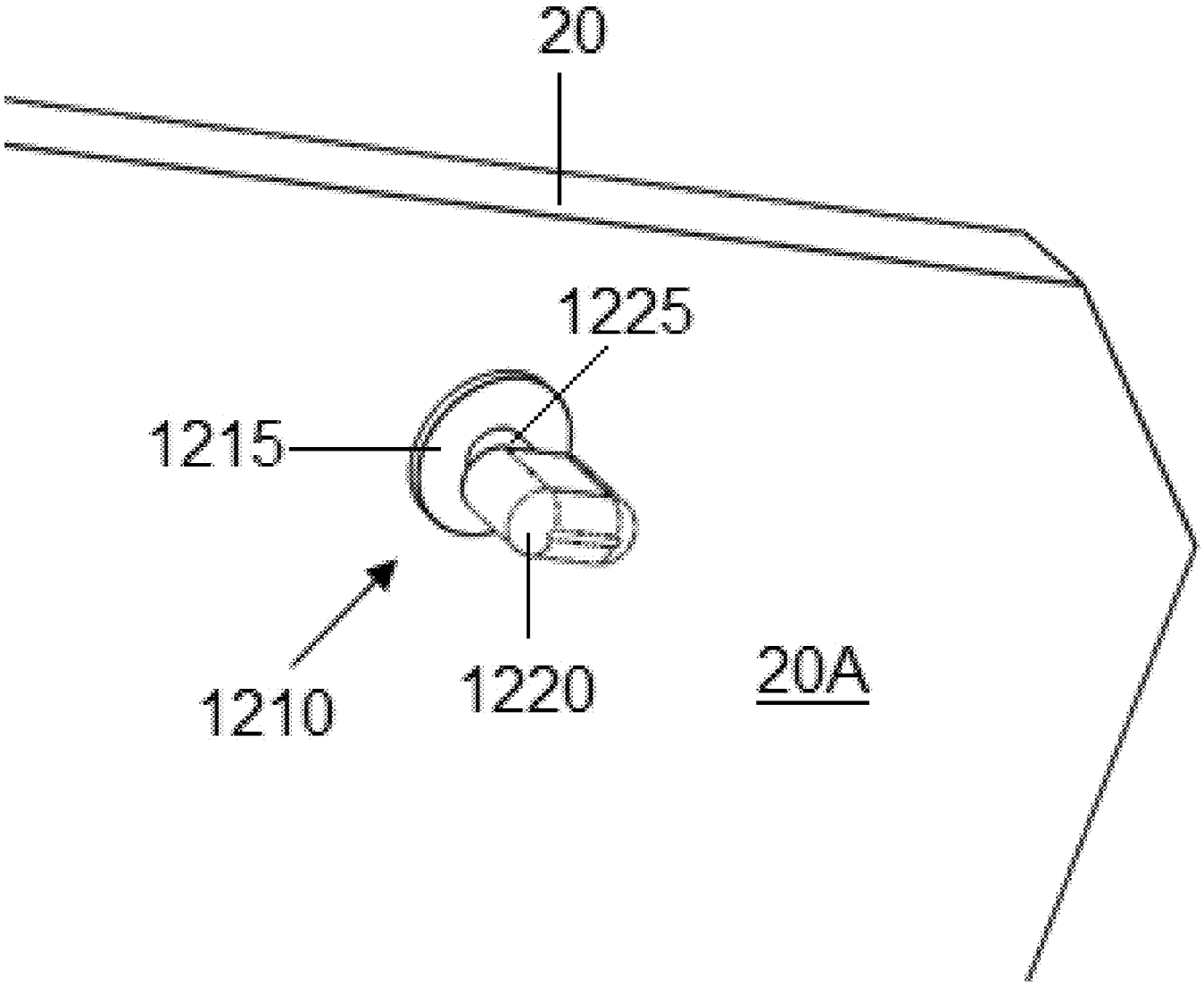
FIG. 17 illustrates an example of a turn lock assembly coupled to the bottom surface of a mattress for a play yard.
Figure 18:
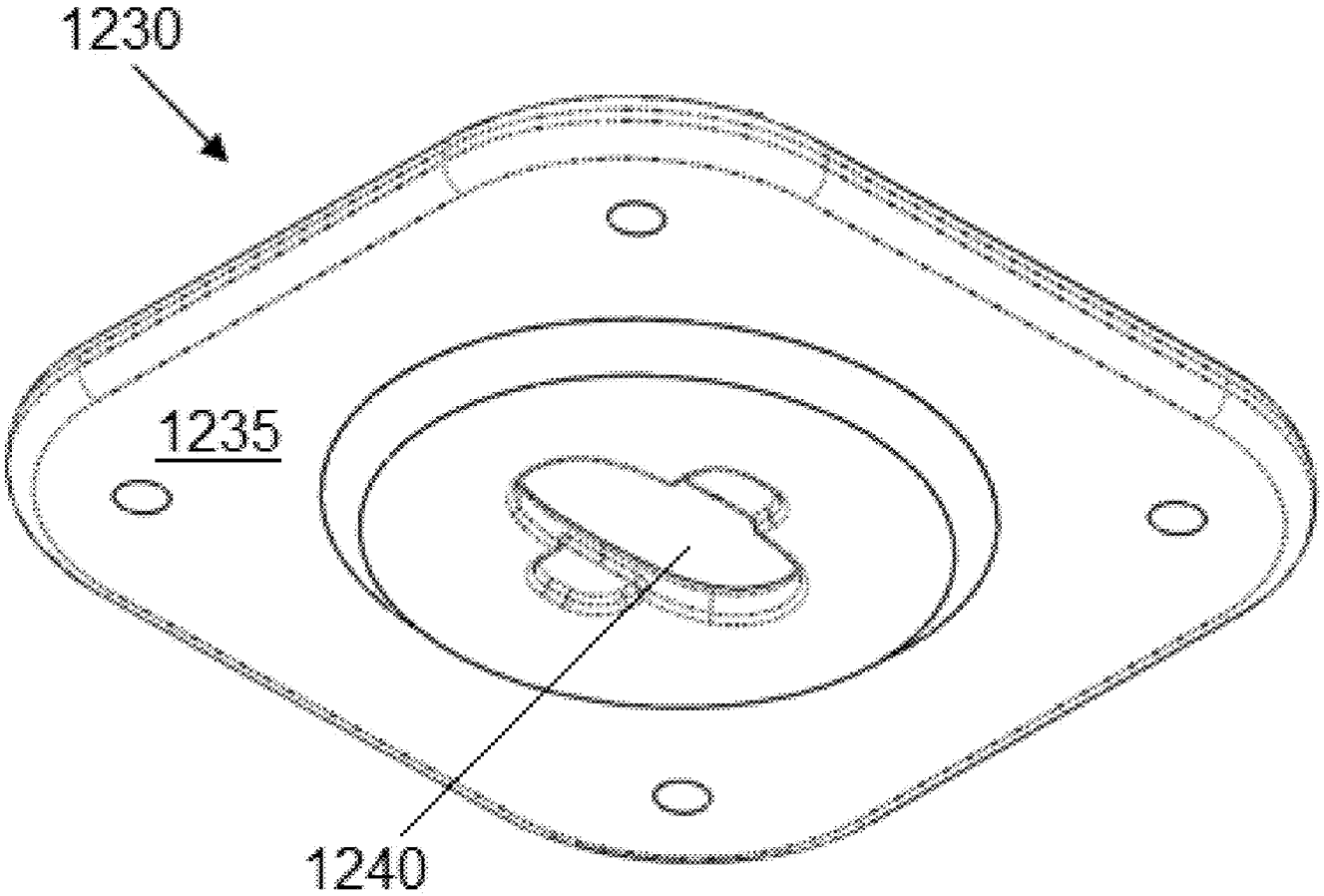
FIG. 18 illustrates an example of turn lock retention assembly for receiving and retaining a turn lock assembly as illustrated in FIG. 17.
Figure 19A:
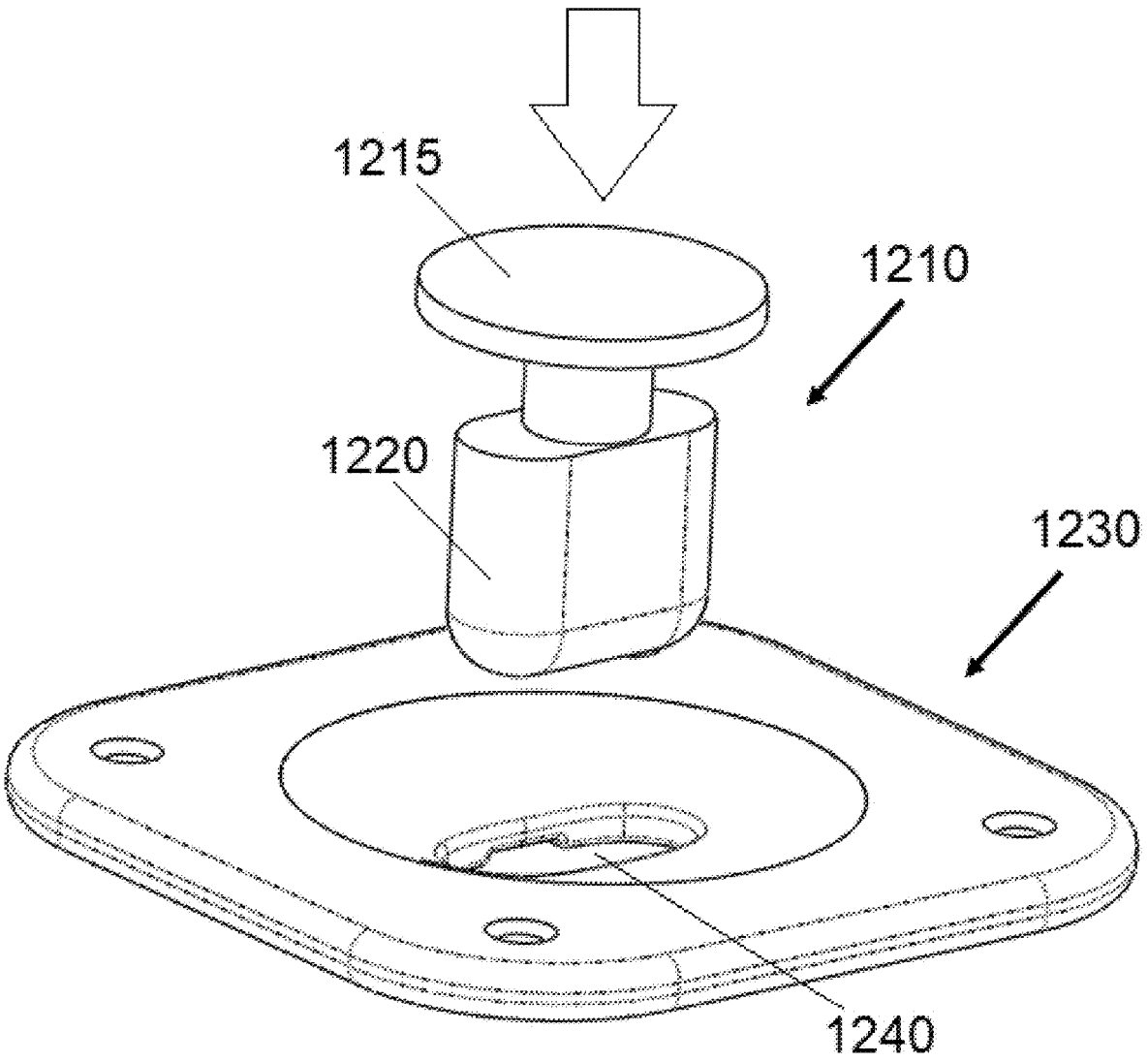
FIGS. 19A-19C illustrate an example of coupling a turn lock assembly as illustrated in FIG. 17 to a turn lock retention assembly as illustrated in FIG. 18.
Figure 19B:
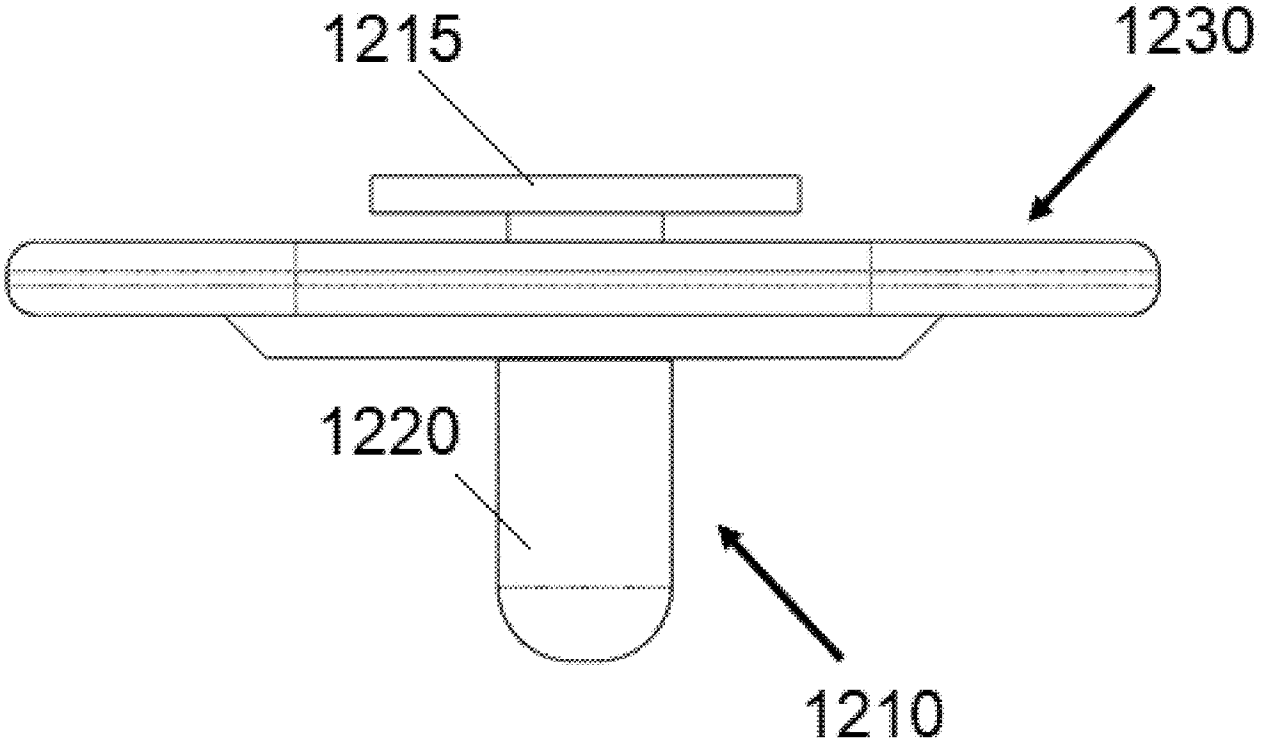
Figure 19C:
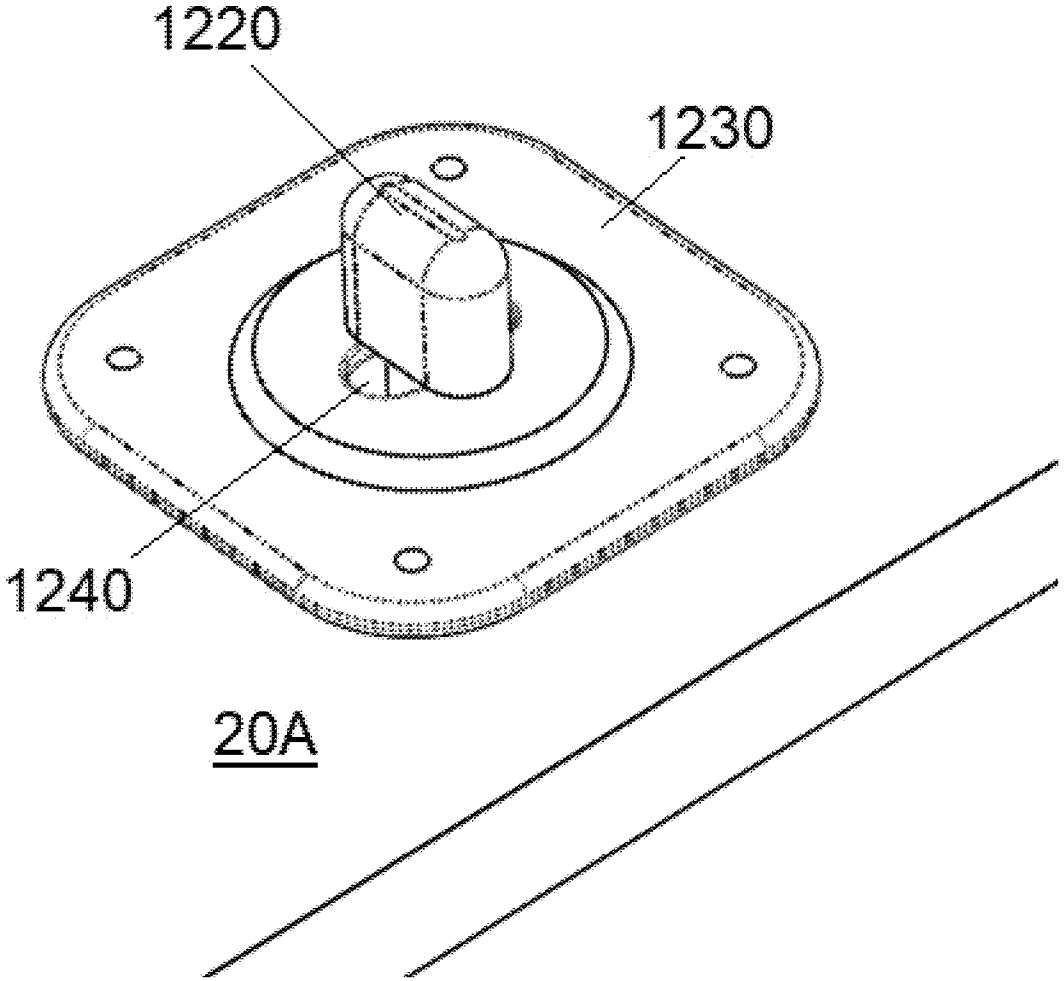

In another example, a mattress of a play yard may be removably secured to the frame of the play yard with a turn lock assembly and corresponding turn lock retention assembly. FIG. 17 illustrates a turn lock assembly 1210 coupled to the bottom surface 20A of a mattress 20 for a play yard. The turn lock assembly 1210 includes a base 1215 that may be secured to the lower side 20A of the mattress by stitching or sewing, with an adhesive, or by plastic welding or other forms of securing articles to one another known in the art. A locking detent 1220 is rotatably coupled to the base 1215 via a shaft 1225. A corresponding turn lock retention assembly 1230 is illustrated in FIG. 18. The turn lock retention assembly 1230 may be coupled to a floor 15A of a play yard in a similar manner as a retention assembly 300 as described above. The turn lock retention assembly 1230 includes a body 1235 defining an aperture 1240 having a cross-section having the same shape as a cross-section of the locking detent 1220 of the turn lock assembly 1210 but dimensioned such that the locking detent 1220 may pass through the aperture 1240 when in an unlocked rotational configuration. As illustrated in FIGS. 19A-19C, in which the floor 15A (and in FIGS. 19A and 19B, the mattress) are omitted for clarity, the locking detent 1220 of the turn lock assembly

1210 may be lowered through the aperture 1240 of the turn lock retention assembly 1230. The locking detent 1220 of the turn lock assembly 1210 may then be rotated, for example, by about 90 degrees. The locking detent 1220, in the rotated state, cannot fit back through the aperture 1240 of the turn lock retention assembly 1230 and is trapped beneath the turn lock retention assembly 1230 and floor 15A, removably coupling the mattress 20 to the floor 15A. To remove the mattress 20 from the floor 15A, the locking detent 1220 may be rotated back into a position in which it will pass through the aperture 1240 of the turn lock retention assembly 1230. As with the clip assemblies 200 and retention assemblies 300 described above, a mattress and floor of a play yard may include multiple pairs of turn lock assemblies 1210 and turn lock retention assemblies 1230 disposed about one or more walls of a mattress and floor of a play yard to removably secure the mattress to the floor.

Having thus described several aspects of at least one embodiment of this disclosure, it is to be appreciated that various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A child play yard comprising:

a frame;

a floor coupled to a lower portion of the frame; and a mattress configured to be removably coupled to the floor, the mattress including a lower side to which is coupled a clip assembly including a base and a leg pivotally coupled to the base, the leg including a detent extending therefrom, the floor including a retention assembly having a first aperture through which the leg of the clip assembly passes and a second aperture through which the detent passes when the mattress is coupled to the floor, wherein the clip assembly further includes a detent retention aperture defined in the base in which the detent is disposed when the mattress is coupled to the floor.

2. The play yard of claim 1, wherein the base of the clip assembly is secured to the lower side of the mattress by one or stitching, sewing, or an adhesive.

3. The play yard of claim 1, wherein the clip assembly further includes raised side walls extending upward from the base and apertures defined in the raised side walls, the apertures configured to retain a pin that pivotally couples the leg to the base.

4. The play yard of claim 3, wherein the clip assembly further includes a loop portion extending rearward and upward from the raised side walls.

5. The play yard of claim 4, wherein the clip assembly further includes a raised plateau extending upward from the base.

6. The play yard of claim 5, wherein the clip assembly further includes a cavity having a rounded bottom defined between the raised side walls, a front wall of the loop portion, and a rear of the raised plateau.

7. The play yard of claim 5, wherein the raised plateau and leg define a cavity in which a portion of the retention assembly is retained when the mattress is coupled to the floor.

8. The play yard of claim 7, wherein the portion of the retention assembly is defined between the first aperture and the second aperture.

9. The play yard of claim 5, wherein the leg includes a rounded proximal end pivotally coupled to the base within the cavity.

10. The play yard of claim 1, wherein the retention assembly is secured to the floor by one of stitching, sewing, or an adhesive.

11. A method of removably securing a mattress to a floor of a play yard, the method comprising:

placing the mattress on the floor of the play yard;

passing a leg of a clip assembly through a first aperture in a retention assembly coupled to the floor of the play yard from an upper side of the floor to a lower side of the floor;

passing a detent coupled to the leg of the clip assembly through a second aperture in the retention assembly from the lower side of the floor to the upper side of the floor by rotating the leg of the clip assembly relative to a base of the clip assembly;

removably securing the detent in a detent retention aperture defined in the base; and trapping a portion of the retention assembly defined between the first aperture and the second aperture between a lower side of the clip and a raised plateau extending upward from the base.

12. The method of claim 11, wherein securing the mattress to the floor of the play yard includes securing a first end of the mattress to the floor of the play yard with a plurality of clip assemblies and associated retention assemblies.

13. The method of claim 12, wherein securing the mattress to the floor of the play yard further includes securing a second end of the mattress opposite to the first end of the mattress to the floor of the play yard with a second plurality of clip assemblies and associated retention assemblies.

14. The method of claim 11, wherein removably securing the detent in the detent retention aperture includes applying a force to a handle portion of the leg.

15. The method of claim 11, further comprising:

removing the mattress from the play yard;

rolling the mattress into a closed configuration; and securing the mattress in the closed configuration by coupling a loop portion of the clip assembly to a loop portion of a second clip assembly coupled to the mattress with a fastener.

16. A child play yard comprising:

a frame;

a floor coupled to a lower portion of the frame; and a mattress configured to be removably coupled to the floor, the mattress including a lower side to which is coupled a clip assembly including a base and a leg pivotally coupled to the base, the leg including a detent extending therefrom, the floor including a retention assembly having a first aperture through which the leg of the clip assembly passes and a second aperture through which the detent passes when the mattress is coupled to the floor, wherein the clip assembly further includes raised side walls extending upward from the base and apertures defined in the raised side walls, the apertures configured to retain a pin that pivotally couples the leg to the base, a loop portion extending rearward and upward from the raised side walls, and a raised plateau extending upward from the base.

* * * * *